US008708449B2

(12) United States Patent
Shinkawa

(10) Patent No.: US 8,708,449 B2
(45) Date of Patent: Apr. 29, 2014

(54) LIQUID EJECTION DEVICE AND LIQUID TESTING METHOD

(75) Inventor: Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 282 days.

(21) Appl. No.: 13/096,291

(22) Filed: Apr. 28, 2011

(65) Prior Publication Data

US 2011/0285771 A1 Nov. 24, 2011

(30) Foreign Application Priority Data

May 18, 2010 (JP) ..... 2010-113971

(51) Int. Cl.
*B41J 29/393* (2006.01)
*B41J 29/38* (2006.01)

(52) U.S. Cl.
USPC ..... 347/19; 347/14; 347/15

(58) Field of Classification Search
USPC ..... 347/5, 9, 12, 19, 14, 15
IPC ..... B41J 2/16579,2/2142
See application file for complete search history.

(56) References Cited

U.S. PATENT DOCUMENTS

| | | | | |
|---|---|---|---|---|
| 6,550,885 | B2 | 4/2003 | Matsumoto et al. | |
| 7,429,093 | B2 | 9/2008 | Shinkawa | |
| 7,566,109 | B2 | 7/2009 | Shinkawa et al. | |
| 2003/0043221 | A1 * | 3/2003 | Vega et al. | 347/19 |
| 2004/0223027 | A1 | 11/2004 | Shinkawa et al. | |
| 2004/0227782 | A1 | 11/2004 | Shinkawa et al. | |
| 2004/0239714 | A1 | 12/2004 | Sakagami et al. | |
| 2004/0252144 | A1 | 12/2004 | Higuchi et al. | |
| 2004/0252151 | A1 | 12/2004 | Higuchi et al. | |
| 2005/0057596 | A1 | 3/2005 | Shinkawa et al. | |
| 2005/0062781 | A1 | 3/2005 | Shinkawa | |
| 2005/0116977 | A1 | 6/2005 | Shinkawa et al. | |
| 2005/0122360 | A1 | 6/2005 | Sakagami et al. | |
| 2005/0128232 | A1 | 6/2005 | Shinkawa | |
| 2005/0212845 | A1 | 9/2005 | Shinkawa | |
| 2005/0212846 | A1 | 9/2005 | Shinkawa et al. | |
| 2008/0088657 | A1 | 4/2008 | Shinkawa et al. | |

FOREIGN PATENT DOCUMENTS

| | | | |
|---|---|---|---|
| CN | 1753784 | A | 3/2006 |
| JP | 09-201967 | A | 8/1997 |
| JP | 2004-276273 | A | 10/2004 |
| JP | 2004-291473 | A | 10/2004 |
| JP | 2004-299341 | A | 10/2004 |
| JP | 2006-116705 | A | 5/2006 |
| JP | 3794431 | B | 7/2006 |
| JP | 2007-030344 | A | 2/2007 |
| JP | 2007-118459 | A | 5/2007 |

* cited by examiner

*Primary Examiner* — Lam S Nguyen
(74) *Attorney, Agent, or Firm* — Global IP Counselors, LLP

(57) ABSTRACT

A liquid ejection device includes a plurality of nozzles and a common ejection testing portion. The nozzles are arranged to eject a liquid. The common ejection testing portion is provided in common to the nozzles, the common ejection testing portion being arranged to perform ejection testing of each of the nozzles during printing. At least one of the nozzles is selected to be tested using the common ejection testing portion when the liquid is ejected from the nozzles based on print data. The nozzles that eject liquid being identified based on the print data, and one of the nozzles, which have not been tested, having low ejection frequency based on the print data being selected as the at least one of the nozzles to be tested.

6 Claims, 18 Drawing Sheets

LIQUID EJECTION DEVICE AND LIQUID TESTING METHOD

CROSS-REFERENCE TO RELATED APPLICATIONS

This application claims priority to Japanese Patent Application No. 2010-113971 filed on May 18, 2010. The entire disclosure of Japanese Patent Application No. 2010-113971 is hereby incorporated herein by reference.

BACKGROUND

1. Technical Field

The present invention relates to a liquid ejection device and to an ejection testing method.

2. Related Art

Printers adapted to eject a liquid (e.g., ink) from nozzles through driving of piezoelectric elements (piezo elements) are one class of devices known in the field of liquid ejection devices. In such printers, it has been proposed to sense residual oscillation of the pressure chambers subsequent to driving of the piezoelectric elements, and to then perform ejection testing of the nozzles based on residual oscillation thereof (see Japanese Patent No. 3794431, for example). In the printer according to Japanese Patent No. 3794431, ejection testing of nozzles can be performed during printing. For this reason, ink viscosity and abnormal conditions of nozzles can be sensed, even during printing.

SUMMARY

In situations where ejection testing of nozzles is performed by a common ejection testing portion during printing, when ejecting ink from a plurality of nozzles it is necessary to select a nozzle to be tested from among the ink-ejecting nozzles, and to perform ejection testing thereof. Therefore, if nozzles having low ejection frequency during printing are present, a resultant risk is that there may be few opportunities to perform ejection testing of these nozzles.

Accordingly, it is an object of the present invention to perform ejection testing of nozzles in a more reliable manner during printing.

A liquid ejection device according to one aspect of the present invention includes a plurality of nozzles and a common ejection testing portion. The nozzles are arranged to eject a liquid. The common ejection testing portion is provided in common to the nozzles, the common ejection testing portion being arranged to perform ejection testing of each of the nozzles during printing. At least one of the nozzles is selected to be tested using the common ejection testing portion when the liquid is ejected from the nozzles based on print data. The nozzles that eject liquid being identified based on the print data, and one of the nozzles, which have not been tested, having low ejection frequency based on the print data being selected as the at least one of the nozzles to be tested.

These and other features of the present invention will be appreciated from the disclosure of the description and accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
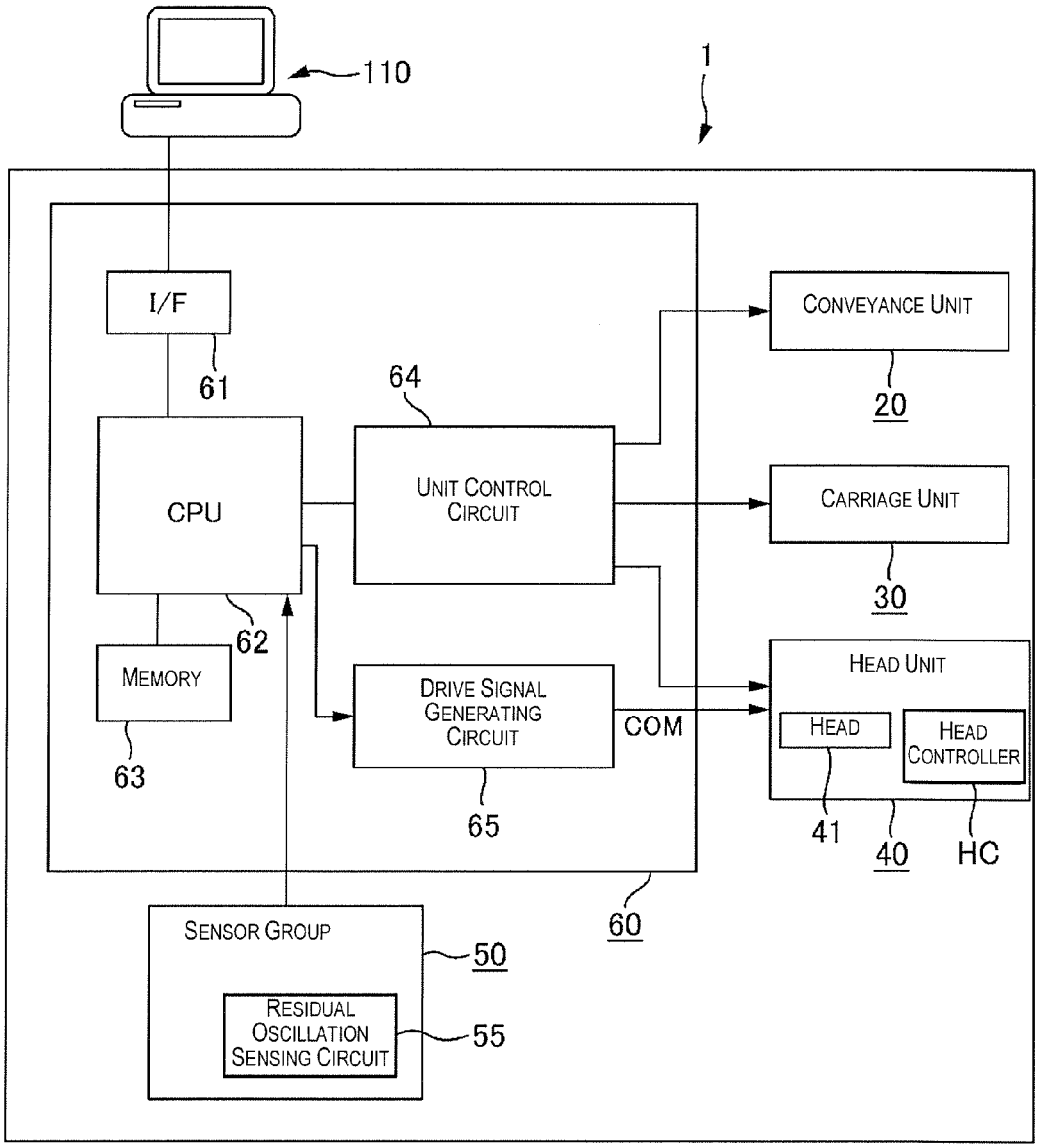
FIG. 1 is a block diagram of the general configuration of a printer 1.

At a minimum, the following features will be appreciated from the disclosure of the description and accompanying drawings.

A liquid ejection device includes a plurality of nozzles and a common ejection testing portion. The nozzles are arranged to eject a liquid. The common ejection testing portion is provided in common to the nozzles, the common ejection testing portion being arranged to perform ejection testing of each of the nozzles during printing. At least one of the nozzles is selected to be tested using the common ejection testing portion when the liquid is ejected from the nozzles based on print data. The nozzles that eject liquid being identified based on the print data, and one of the nozzles, which have not been tested, having low ejection frequency based on the print data being selected as the at least one of the nozzles to be tested.

According to the liquid ejection device of the aspect described above, ejection testing of nozzles can be performed in a more reliable manner during printing.

In the ink ejection device, in preferred practice, when a plurality of the nozzles, which have not been tested, have identical ejection frequency, one of the nozzles that does not eject the liquid for a prolonged period based on the print data is selected as the at least one of the nozzles to be tested.

According to the liquid ejection device of the aspect described above, ejection testing can be performed in a manner that takes the effects produced by drying out of the ink into account.

In the ink ejection device, in preferred practice, when all of the nozzles that eject the liquid based on the print data have been tested, one of the nozzles for which a prolonged interval has passed since ejection testing last took place is selected as the at least one of the nozzles to be tested.

According to the liquid ejection device of the aspect described above, ejection testing can be performed in a manner that takes the effects produced by drying out of the ink into account.

The liquid ejection device, in preferred practice, further includes a plurality of piezoelectric elements provided in respective correspondence to the nozzles, and a drive signal generating portion arranged to generate a drive signal which repeats for each of ejection cycles in which the nozzles eject the liquid onto a pixel, the drive signal having a testing period within each of the ejection cycles. At least one of the piezoelectric elements corresponding to the at least one of the nozzles to be tested is driven within a given ejection cycle of the drive signal, whereupon the at least one of the nozzles to be tested is tested using the common ejection testing portion during the testing period of the same given ejection cycle.

According to the liquid ejection device of the aspect described above, ejection testing of a specific nozzle can be performed with a simple configuration, and irrespective of conditions of usage of other nozzles.

The liquid ejection device, in preferred practice, further includes a plurality of first switches provided individually to the piezoelectric elements, the first switches being arranged to switch between applying and not applying the drive signal to one terminal of each of the piezoelectric elements, and a second switch provided in common to the piezoelectric elements, the second switch being arranged to switch between applying a prescribed voltage to the other terminals of the piezoelectric elements and outputting a voltage at the other terminals of the piezoelectric elements to the common ejection testing portion. During a period prior to the testing period, the drive signal is applied at least to the one terminal of one of the piezoelectric elements corresponding to the at least one of the nozzles to be tested, and the prescribed voltage is applied to the other terminals of the piezoelectric elements. During the testing period, the drive signal is constant, and the drive signal is applied to the one terminal of the one of the piezoelectric elements corresponding to the at least one of the nozzles to be tested while the drive signal is not applied to terminals of the piezoelectric elements corresponding to the nozzles not to be tested, and the voltage of the other terminals of the piezoelectric elements is output to the common ejection testing portion.

According to the liquid ejection device of the aspect described above, ejection testing of nozzles to be tested can be performed reliably during testing periods.

In the liquid ejection device, in preferred practice, the second switch is a transistor, and the common ejection testing portion has: an AC amplifier circuit arranged to amplify an AC component of residual oscillation after the piezoelectric elements have been driven by the drive signal; a comparator circuit arranged to compare an output of the AC amplifier circuit to a reference voltage; and a logic circuit arranged to perform a logic operation on a control signal to a control electrode of the second switch and on an output of the comparator circuit.

According to the liquid ejection device of the aspect described above, ejection testing of a nozzle to be tested can be performed on the basis of residual oscillation subsequent to driving of the piezoelectric element.

An ejection testing method is a method for a liquid ejection device having a plurality of nozzles for ejecting a liquid, and a common ejection testing portion provided in common to the plurality of nozzles, the common ejection testing portion being adapted to perform ejection testing of each of the nozzles during printing. The ejection testing method includes: identifying, based on print data, the nozzles that eject the liquid; selecting one of the nozzles having low ejection frequency, based on the print data, as at least one of the nozzles to be tested from among the nozzles that eject the liquid and that have not been tested; and testing the at least one of the nozzles to be tested with the common ejection testing portion subsequent to ejection of the liquid from the nozzles based on the print data.

The following description of the embodiments takes the example of an inkjet printer (herein also termed printer 1) as the ink ejection device.

Printer Configuration

Figure 2A:
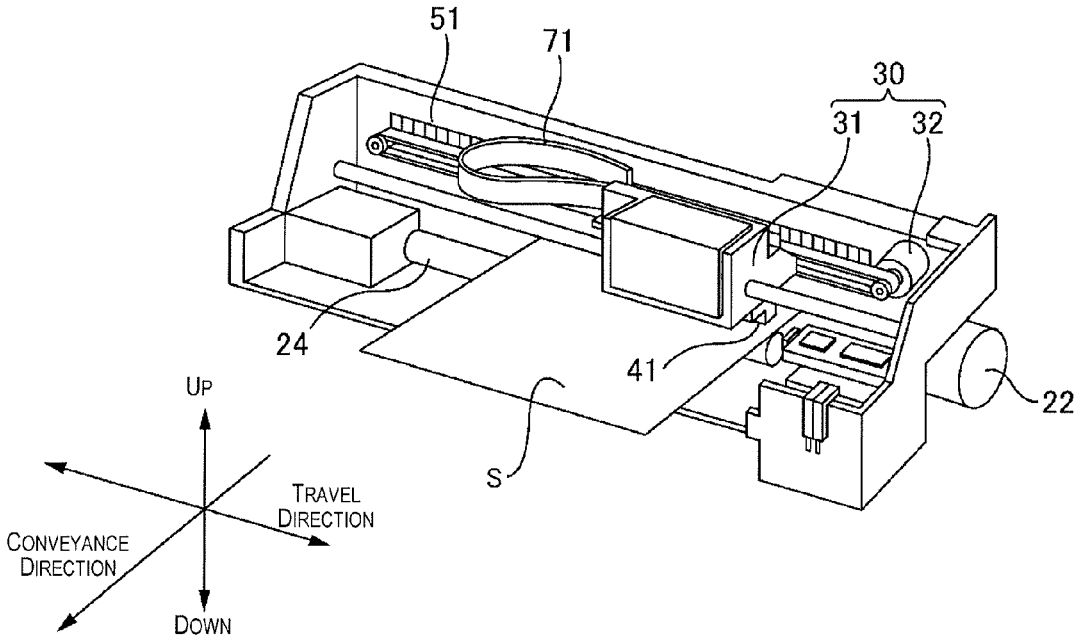
FIG. 2A is a perspective view of the printer 1.
Figure 2B:
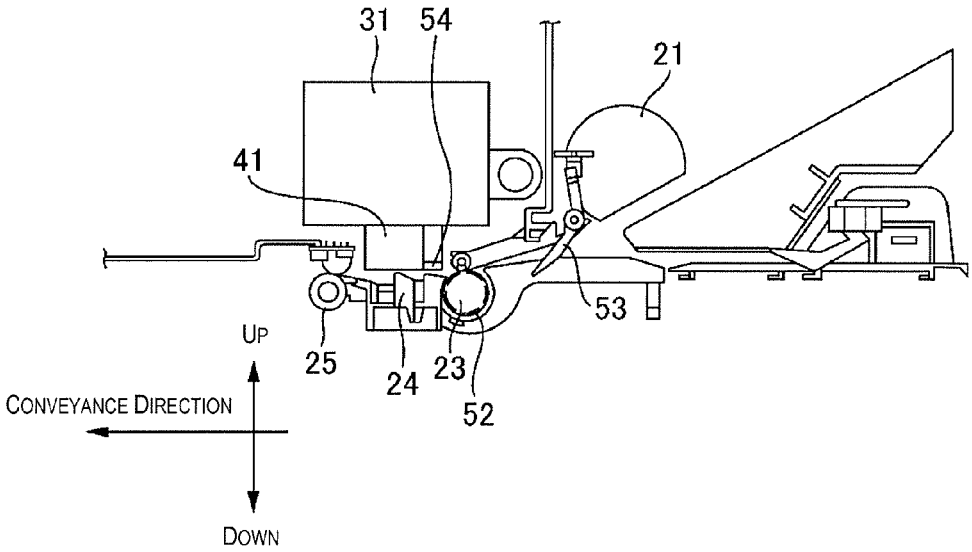
FIG. 2B is a transverse sectional view of the printer 1.

FIG. 1 is a block diagram of the general configuration of the printer 1 of the present embodiment. FIG. 2A is a perspective view of the printer 1, and FIG. 2B is a transverse sectional view of the printer 1. Following is a description of the basic configuration of the printer 1 of the present embodiment.

The printer 1 of the present embodiment has a conveyance unit 20, a carriage unit 30, a head unit 40, a sensor group 50, and a controller 60. Having received print data from an external device, specifically, a computer 110, the printer 1 controls the various units (the conveyance unit 20, the carriage unit 30, and the head unit 40) with the controller 60. On the basis of print data received from the computer 110, the controller 60 controls the various units and prints images onto paper. Conditions in the printer 1 are monitored by the sensor group 50, and the sensor group 50 outputs sensed results to the controller 60. The controller 60 controls the various units on the basis of sensed results output by the sensor group 50.

The conveyance unit 20 is adapted to convey a medium (such as paper S, for example) in a prescribed direction (herein termed the conveyance direction). This conveyance unit 20 has a paper supply roller 21, a conveyance motor 22 (also called a PF motor), a conveyance roller 23, a platen 24, and paper ejection roller 25. The paper supply roller 21 is a roller that is used to supply paper that has been inserted into a paper insertion slot to the interior of the printer. The conveyance roller 23 is a roller used to convey to a printable area the paper S that is supplied by the paper supply roller 21, and is driven by the conveyance motor 22. The platen 24 supports the paper S during printing. The paper ejection roller 25 is a roller used to eject the paper S from the printer, and is disposed to the downstream end in the conveyance direction from the printable area.

The carriage unit 30 is adapted to cause the head to travel (also termed "scan") in a prescribed direction (herein termed "travel direction"). The carriage unit 30 has a carriage 31 and a carriage motor 32 (also called a CR motor). The carriage 31 is capable of reciprocating travel in the travel direction, and is driven by the carriage motor 32. The carriage 31 detachably retains an ink cartridge which contains ink.

The head unit 40 is adapted to eject ink onto paper. The head unit 40 has a head controller HC and a head 41 having a plurality of nozzles. Because the head 41 is disposed on the carriage 31, when the carriage 31 travels in the travel direction, the head 41 likewise travels in the travel direction. By ejecting ink intermittently in the course of travel of the head 41 in the travel direction, dot lines (raster lines) are formed on the paper along the travel direction.

The head controller HC is used to control driving of the head 41, etc. In response to a head control signal from the controller 60, the head controller HC selectively actuates piezoelectric actuators which correspond to the nozzles of the head 41. Ink is thereby ejected from the nozzles of the head 41. A more detailed discussion of the head unit 40 follows later.

The sensor group 50 includes a linear encoder 51, a rotary encoder 52, a paper supply sensor 53, and an optical sensor 54, etc. The linear encoder 51 senses the location of the carriage 31 in the travel direction. The rotary encoder 52 senses the rotation rate of the conveyance roller 23. The paper supply sensor 53 senses the location of the leading edge of the paper during paper supply. The optical sensor 54 uses a light emitter and a light receptor which are mounted on the carriage 31 to sense whether paper is present. The optical sensor 54 is able to sense the locations of the edges of the paper during travel of the carriage 31 and sense the width of the paper. Depending on circumstances, the optical sensor 54 may also be adapted to sense the leading edge (the edge at the downstream side in the conveyance direction, also called the top edge) and the trailing edge (the edge at the upstream side in the conveyance direction, also called the bottom edge) of the paper.

The printer 1 of the present embodiment is also provided as part of the sensor group 50 with a residual oscillation sensing circuit 55 (corresponding to the common ejection testing portion) for performing ejection testing (herein also called nozzle testing) of the nozzles. The residual oscillation sensing circuit 55 is discussed in detail later.

The controller 60 is a control unit for performing control of the printer. The controller 60 has an interface 61, a CPU 62, a memory 63, a unit control circuit 64, and a drive signal generating circuit 65. The interface 61 performs sending and receiving of data between an external device, namely the computer 110, and the printer 1. The CPU 62 is a processing unit for performing control of the entire printer. The memory 63 secures an area for the CPU 62 to store programs, a work area, etc., and has storage elements such as RAM or EEPROM. The CPU 62, via the unit control circuit 64, controls the various units in accordance with a program stored in the memory 63.

The drive signal generating circuit 65 generates a drive signal COM for driving the head 41. The drive signal generating circuit 65 is discussed in detail later.

The controller 60 of the present embodiment performs a process to make a normal/abnormal condition determination for each nozzle, based on the sensed results from the residual oscillation sensing circuit 55 (discussed later).

A flexible cable 71 is made of flexible wires, and transmits various types of signals between the controller 60 and the head unit 40.

Printing Procedure

Upon receiving a print command and print data from the computer 110, the controller 60 parses the content of various commands included in the print data, and uses the various units to carry out the following process.

First, the controller 60 rotates the paper supply roller 21 and advances the paper S to be printed to the conveyance roller 23. Next, the controller 60 drives the conveyance motor 22 to rotate the conveyance roller 23. As the conveyance roller 23 rotates at a prescribed rotation rate, the paper S is conveyed along at a prescribed conveyance rate.

Once the paper S is conveyed to below the head unit 40, the controller 60 rotates the carriage motor 32 on the basis of the print command. In response to this rotation of the carriage motor 32, the carriage 31 experiences reciprocating travel in the travel direction in a pattern of acceleration→constant speed→deceleration→return→acceleration→constant speed→deceleration→return. Through travel of the carriage 31, the head unit 40 which is disposed on the carriage 31 also travels in the travel direction at the same time. During travel of the head unit 40 in the travel direction, the controller 60 generates a drive signal COM with the drive signal generating circuit 65, and applies the drive signal COM to the piezoelectric actuators of the head 41. Thereby, ink drops are ejected intermittently from the head 41 during travel (constant speed intervals) of the head unit 40 in the travel direction through the printing area. These ink drops land on the paper S, whereby the ink drops form dot rows in which a plurality of dots line up in the travel direction. The dot formation operation which takes place through ejection of ink from the traveling head 41 is also termed a pass.

The controller 60 drives the conveyance motor 22 during periods of reciprocating travel by the head unit 40. The conveyance motor 22 generates driving force in the rotation direction according to the driving rate instructed by the controller 60. The conveyance motor 22 then uses this driving force to rotate the conveyance roller 23. As the conveyance roller 23 rotates at a prescribed rotation rate, the paper S is conveyed along at a prescribed conveyance rate. That is, the conveyance rate of the paper S is determined according to the rotation rate of the conveyance roller 23. Dots are formed on pixels on the paper S through alternating repetition of passes and conveyance operations in this manner. In this way, an image is printed onto the paper S.

Finally, the controller 60 ejects the completely printed paper S with the paper eject roller 25 which rotates synchronously with the conveyance roller 23.

Overview of Processes Performed by the Printer Driver

Figure 3:
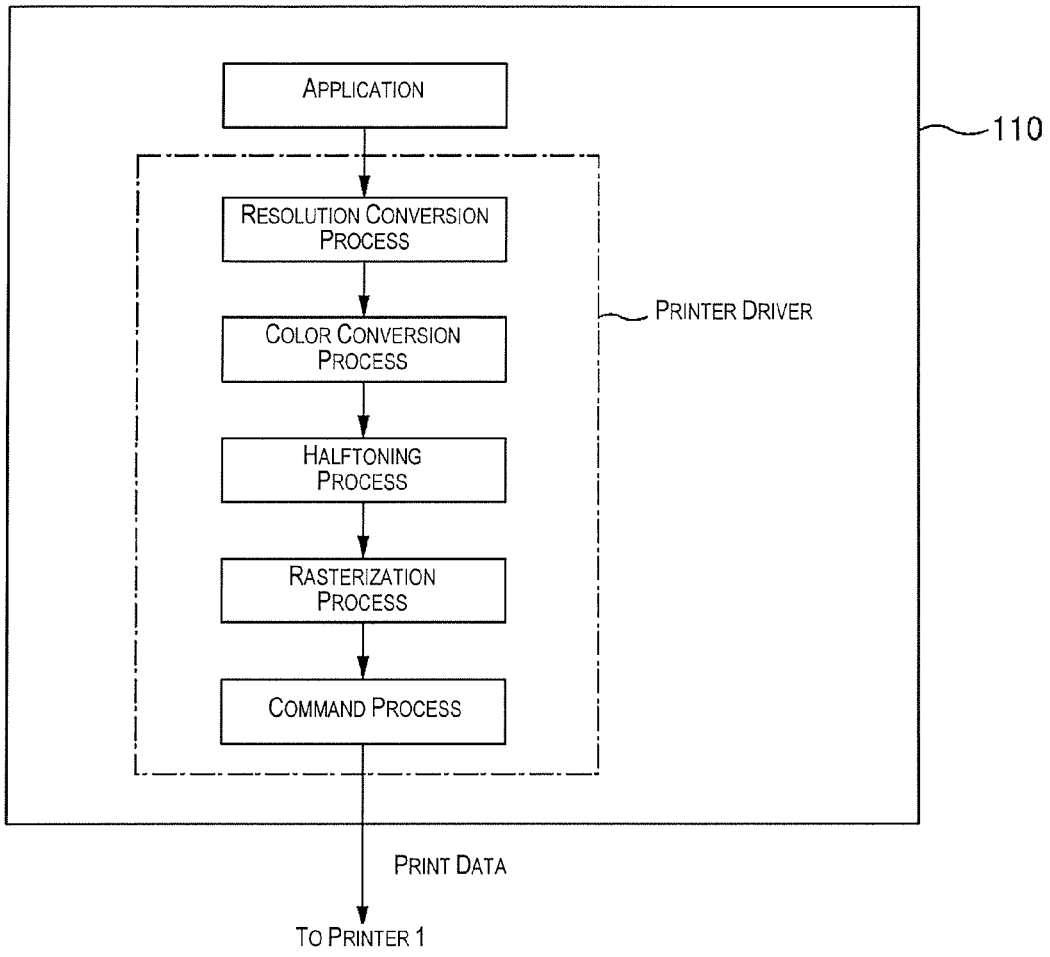
FIG. 3 is an explanatory diagram of processes performed by the printer driver.

As mentioned previously, the printing process described above is initiated through transmission of print data from the computer 110 which is connected to the printer 1. The print data is generated by processes performed by the printer driver. The processes of the printer driver are described below with reference to FIG. 3. FIG. 3 is an explanatory diagram of processes performed by the printer driver.

The printer driver receives graphics data from an application program, converts the print data to a format that can be interpreted by the printer 1, and outputs the print data to the printer. During conversion of graphics data from an application program into print data, the printer driver carries out processes such as a resolution conversion process, a color conversion process, a halftoning process, a rasterization process, a command appending process, and so on.

The resolution conversion process is a process for converting graphics data output from an application program (such as text data or image data) to a different resolution for printing onto paper (the print resolution). For example, where a print resolution of 720×720 dpi has been instructed, the graphics data in vector format received from the application program is converted to graphics data in bitmap format of 720×720 dpi resolution. All graphics data of the graphics data subsequent to the resolution conversion process are multi-tone (e.g., 256-tone) RGB data represented by the RGB color space. These tone values are determined on the basis of the RGB image data, and are also referred to herein as instructed tone values.

The color conversion process is a process for converting RGB data to data of the CMYK color space. Image data of the CMYK color space is data that corresponds to the colors of the inks of the printer. In other words, based on RGB data, the printer driver generates graphics data in the CMYK plane.

This color conversion process is carried out on the basis of a table that associates RGB data tone values and CMYK data tone values (a color conversion lookup table LUT). Subsequent to the color conversion process, the graphics data takes the form of 256-tone CMYK data represented by the CMYK color space.

The halftoning process is a process for converting high-tone data to data having the number of tones reproducible by the printer. Through this halftoning process, data representing 256 tones is converted to 1-bit data representing two tones or 2-bit data representing four tones. In the graphics data after the halftoning process, 1-bit or 2-bit pixel data is associated with each individual pixel, and this graphics data is data indicating a dot state (dot on/off state) for each pixel. According to the present embodiment, the graphics data generated is two-bit data indicating a dot on/off state and a nozzle test on/off state, as discussed later. Subsequently, having determined a dot generation rate for each dot size, a dither method, gamma correction, error diffusion method, or the like is used to create graphics data in which dots are formed in a dispersed pattern.

According to the present embodiment, in this halftoning process, data representing 256 tones is converted to 1-bit data indicating dot on/off states for pixels. Then, in the printer 1, data indicating nozzle testing on/off states is assigned to this 1-bit data to generate 2-bit data. This assignment process is discussed later.

The rasterization process is a process for reordering data arrayed in a matrix pattern, according to the dot formation order during printing. For example, where dot formation processes are carried out in multiple subdivisions during printing, the graphics data corresponding to each dot formation process is respectively extracted and reordered according to the order of dot formation processes. Because the dot formation order during printing differs for different printing formats, the rasterization process is carried out according to the particular printing format.

The command appending process is a process for appending command data in accordance with the printing format to the rasterized data. An example of command data is conveyance data indicating the conveyance speed of a medium.

The print data generated in the course of these processes is sent to the printer 1 by the printer driver.

Configuration of Drive Signal Generating Circuit

Figure 4:
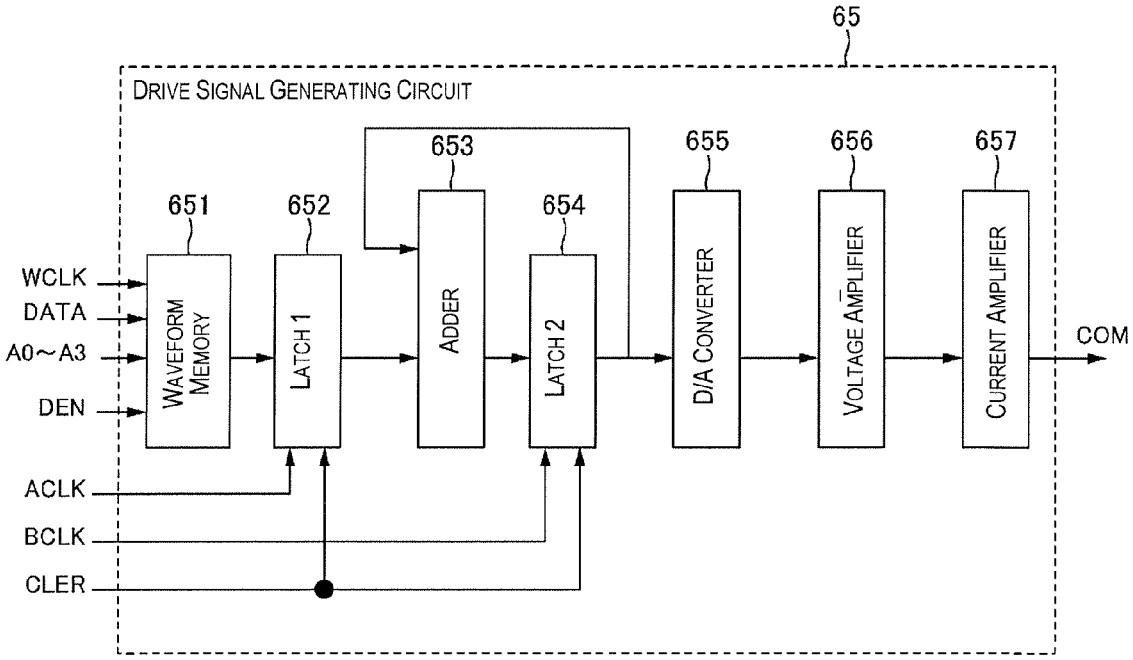
FIG. 4 is a block diagram showing a configuration of a drive signal generating circuit.

FIG. 4 is a block diagram showing a configuration of the drive signal generating circuit 65. The drive signal generating circuit 65 includes a waveform memory 651, a first latch circuit 652, an adder 653, a second latch circuit 654, a D/A converter 655, a voltage amplifier 656, and a current amplifier 657.

The CPU 62 outputs a write enable signal DEN, a write clock signal WCLK, and write address data A0 to A3 to the drive signal generating circuit 65, and writes, for example, 16-bit waveform formation data DATA to the waveform memory 651. The CPU 62 also outputs to the drive signal generating circuit 65 read address data A0 to A3 for reading out waveform formation data DATA stored in this waveform memory 651, a first clock signal ACLK that establishes the timing for latching the waveform formation data DATA that was read from the waveform memory 651, a second clock signal BCLK that establishes the timing for adding the latched waveform data, and a clear signal CLER for clearing latched data.

The waveform memory 651 is used for temporary storage of the waveform formation data DATA input from the CPU 62 for the purpose of generating a drive signal.

The first latch circuit 652 is used to read out and temporarily hold (latch) the necessary waveform formation data DATA from the waveform memory 651, according to the first clock signal ACLK mentioned previously.

The adder 653 adds the waveform formation data WDATA that is output from the first latch circuit 652 and the second latch circuit 654.

The second latch circuit 654 latches the added output of the adder 653 according to the second clock signal BCLK mentioned previously.

The D/A converter 655 converts the waveform formation data WDATA output from the second latch circuit 654 into an analog signal.

The voltage amplifier 656 amplifies the voltage of the analog signal output by the D/A converter 655.

The current amplifier 657 amplifies the current of the analog signal output by the voltage amplifier 656, and outputs the drive signal COM.

The clear signal CLER output by the CPU 62 is input to the first latch circuit 652 and the second latch circuit 654, and when this clear signal CLER goes to the OFF state (low level), the latch data is cleared.

Figure 5:
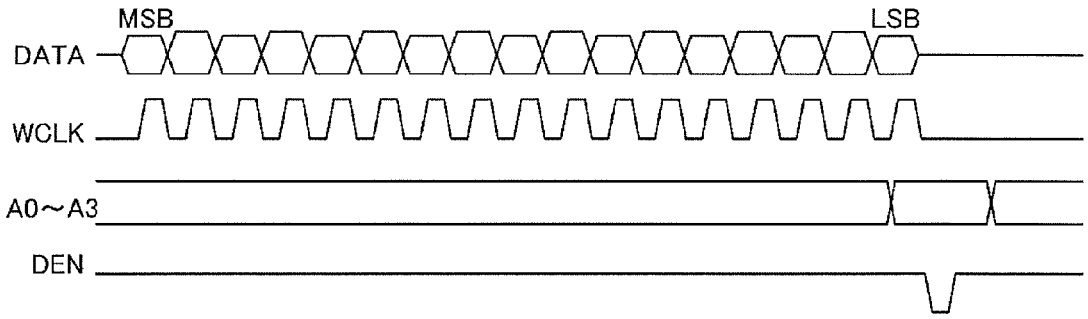
FIG. 5 is a diagram showing timing of writing data to a waveform memory.

FIG. 5 is a diagram showing timing of writing data to the waveform memory 651.

As shown in FIG. 5, memory elements of several bits each are arrayed at the instructed addresses in the waveform memory 651, and the waveform formation data DATA is stored therein together with addresses A0 to A3. Specifically, in synchronization with the clock signal WCLK, the waveform formation data DATA is input to the addresses A0 to A3 instructed by the CPU 62, and the waveform formation data DATA is stored in the memory elements through input of a write enable signal DEN.

Figure 6:
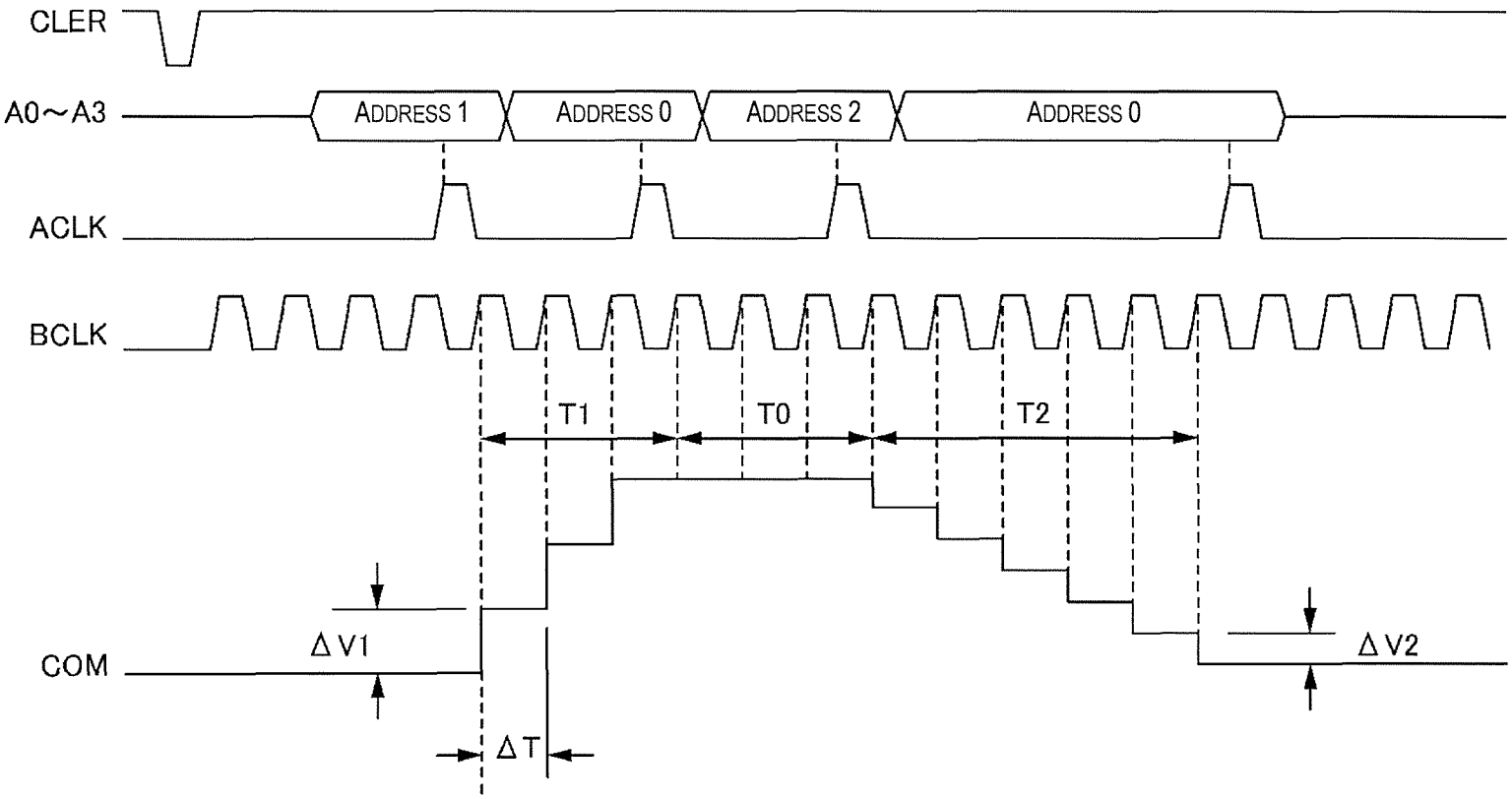
FIG. 6 is a diagram showing timing of reading data from a waveform memory and of generating a drive signal COM.

FIG. 6 is a diagram showing timing of reading data from the waveform memory 651 and of generating a drive signal COM. In this example, waveform data such that the rate of voltage change per unit time is 0 is written to the address A0. Analogously, waveform data of $+\Delta V1$ is written to address A1, of $-\Delta V2$ to address A2, and of $+\Delta V3$ to address A3. The data held in the first latch circuit 652 and the second latch circuit 654 is cleared by the clear signal CLER. In the present embodiment, the drive signal COM begins at ground potential.

From this state, for example, once the waveform data of address A1 is read out and the first clock signal ACLK is input as shown in FIG. 5, digital data of $+\Delta V1$ is held in the first latch circuit 652. The held $+\Delta V1$ digital data is input to the second latch circuit 654 via the adder 653, and in this second latch circuit 654 the output of the adder 653 is held synchronously with the rise of the second clock signal BCLK. Because the output of the second latch circuit 654 is also input to the adder 653, the output (COM) of the second latch circuit 654 is added in $+\Delta V1$ increments at the time of the rise of the second clock signal BCLK. In this example (FIG. 6), during time duration T1, the waveform data of address A1 is read out, and as a result, the $+\Delta V1$ digital data is added until tripled in value.

In analogous fashion, once the waveform data of address A0 is read out and the first clock signal ACLK is input, the digital data held by the first latch circuit 652 switches to 0. In the same way as described above, through the adder 653, this 0 digital data is added at the time of the rise of the second clock signal BCLK, but because the digital data is 0, the previous value is kept substantially unchanged. In this example, the drive signal COM is kept at a constant value during time duration T0.

Next, once the waveform data of address A2 is read out and the first clock signal ACLK is input, the digital data held by the first latch circuit 652 switches to −ΔV2. In the same way as described above, through the adder 653, this −ΔV2 digital data is added synchronously with the rise of the second clock signal BCLK, and because the digital data is −ΔV2, the drive signal COM is subtracted in −ΔV2 increments substantially synchronously with the second clock signal. In this example, during time duration T2, the drive signal COM is subtracted until the −ΔV2 digital data is sextupled in value.

Once waveform data of address A0 is again read out and the voltage change rate goes back to 0, the previous value is kept.

The drive signal COM is generated by a process such as the above. The rising segment of this drive signal COM is a stage in which the volume of an ink cavity 423, discussed later, expands so that ink is drawn in, whereas the falling segment of this drive signal COM is a stage in which the volume of the ink cavity 423 contracts so that ink is ejected. As may readily be inferred from the above, the waveform of the drive signal is adjustable through the waveform data 0, +ΔV1, −ΔV2, +ΔV3 which are written to the addresses A0 to A3, the first clock signal ASCK, and the second clock signal BSCK.

Head Configuration

Figure 7:
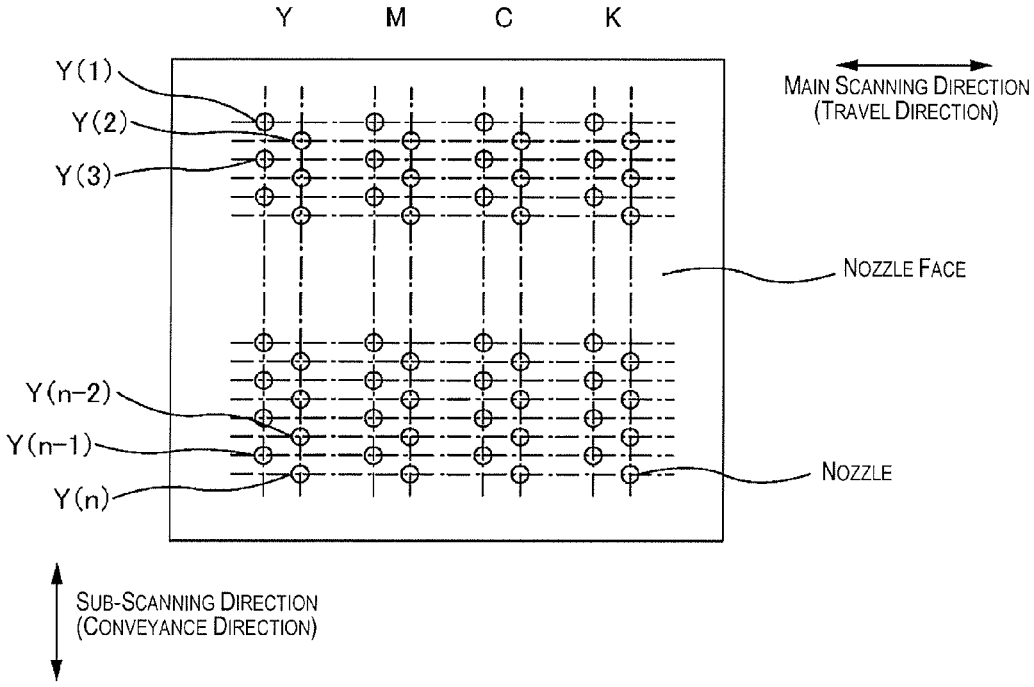
FIG. 7 is a diagram showing an example of nozzle placement on the bottom face of a head.

FIG. 7 is a diagram showing an example of nozzle placement on the bottom face (nozzle face) of the head 41.

A plurality of nozzles are disposed in row arrangement on the head 41 as depicted in FIG. 7. In the example of FIG. 7, there is shown a row arrangement pattern an instance where four colors of ink are used (Y: yellow, M: magenta, C: cyan, K: black); full color printing is possible by combining these colors.

A number n (e.g., 180) nozzles are provided for each color. In the drawing, numbers (Y(1) to Y(n)) are assigned to nozzles in the Y (yellow) nozzle row.

The head 41 of the present embodiment uses piezoelectric actuators (a so-called piezo system), and a piezoelectric actuator is provided in correspondence with each nozzle.

Figure 8:
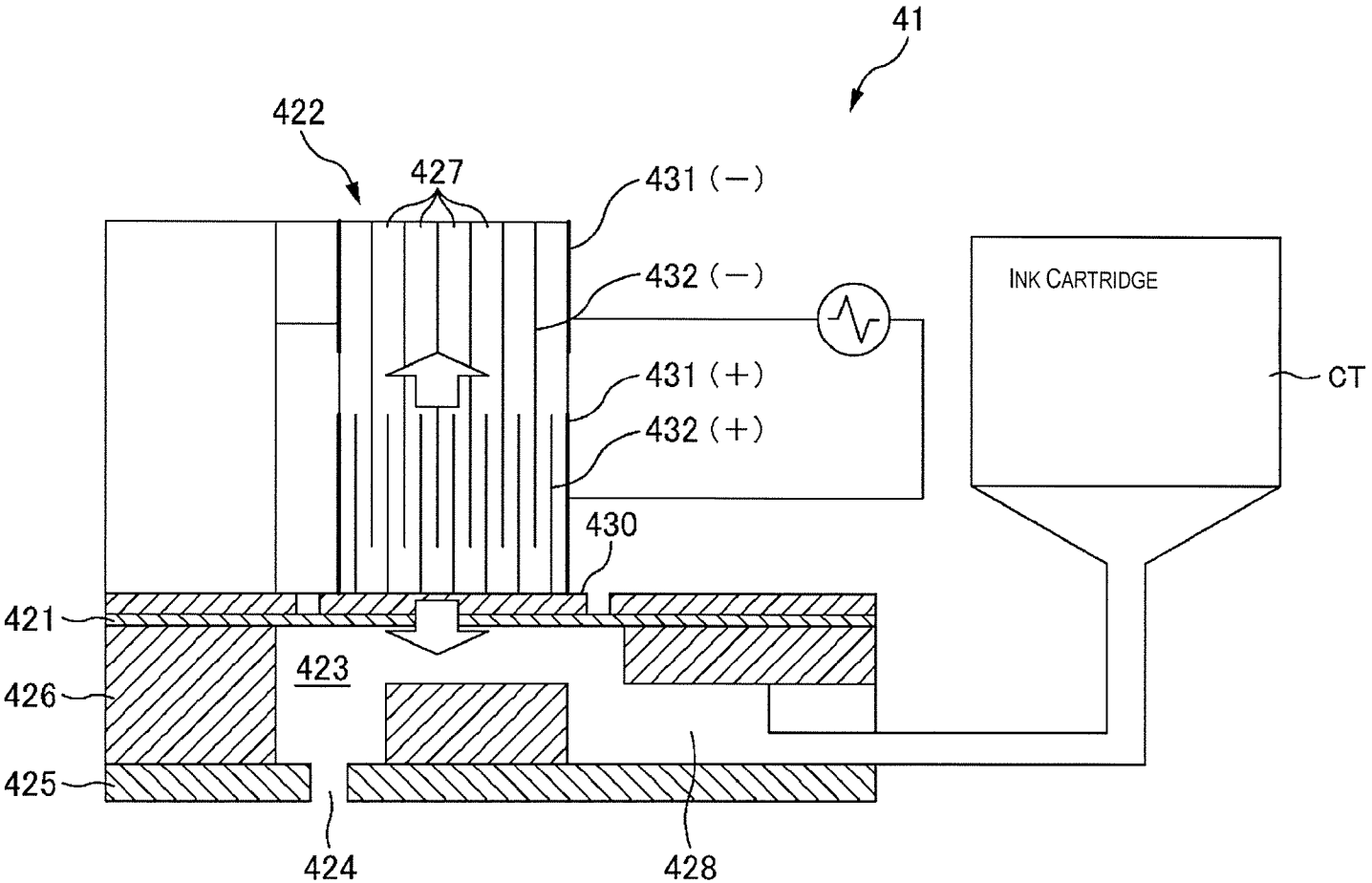
FIG. 8 is a sectional view of the vicinity of a nozzle of a head.

FIG. 8 is a sectional view of the vicinity of a nozzle of the head 41.

As shown in FIG. 8, the head 41 is provided at a minimum with diaphragms 421, piezoelectric actuators 433 for inducing displacement of these diaphragms 421, cavities (pressure chambers) 423 which are internally filled with liquid ink and which experience increase or decrease of internal pressure due to displacement of the diaphragms 421, and nozzles 424 which communicate with the cavities 423 and which eject ink in drop form through increase and decrease of pressure inside the cavities 423.

Turning to a more detailed description, the head 41 is provided with piezoelectric actuators 422 of stacked type composed of a stacked nozzle substrate 425 in which a nozzle 424 is formed, a cavity substrate 426, a diaphragm 421, and a plurality of piezoelectric elements 427. The cavity plate 426 is formed with a prescribed shape as shown in the drawing, thereby defining a cavity 423 and a reservoir 428 which connects therewith. The reservoir 428 is connected to an ink cartridge CT via an ink supply tube 429. Each piezoelectric actuator 422 has a first electrode 431 and a second electrode 432 of pectinate shape disposed facing one another, and piezoelectric elements 427 disposed in alternating fashion with the pectinate teeth of the electrodes (the first electrode 431 and second electrode 432). The piezoelectric actuator 422 is joined at one end thereof to the diaphragm 421 via an intermediate layer 430 as shown in FIG. 8.

In the piezoelectric actuator 422 having the above configuration, a mode of extension and contraction in the vertical direction as shown in FIG. 8 is utilized by applying a drive signal COM across the first electrode 431 and the second electrode 432. Consequently, when a drive signal COM is applied to this piezoelectric actuator 422, displacement of the diaphragm 421 is produced by extension and contraction of the piezoelectric actuator 422, resulting in a change in pressure inside the cavity 423 and ejection of an ink drop 424 from the nozzle 424. More specifically, as will be discussed later, the cavity 423 expands in volume to draw in ink, and then the cavity 423 contracts in volume to eject an ink drop.

Figure 9:
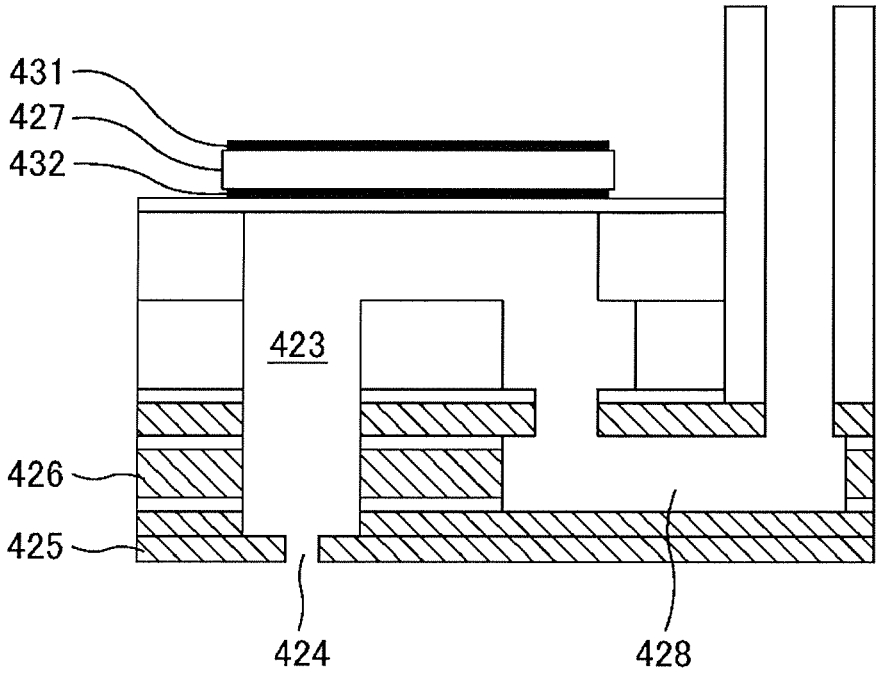
FIG. 9 is a diagram showing another example of a piezoelectric actuator.

FIG. 9 is a diagram showing another example of the piezoelectric actuator 422. The reference numerals in the drawing are the same as those used in FIG. 8. The piezoelectric actuator of FIG. 9 is typically called a unimorph actuator, and has a simple construction in which a piezoelectric element 427 is sandwiched by two electrodes (a first electrode 431 and a second electrode 432). In the case of the construction of FIG. 9, application of a drive signal induces flexing of the piezoelectric element 427 in the vertical direction in the drawing. As with the stacked actuator of FIG. 8, this gives rise to displacement of the diaphragm 421 and to ejection of an ink drop. In this case as well, the cavity 423 expands in volume to draw in ink, and then the cavity 423 contracts in volume to eject an ink drop from the nozzle 424.

The printer 1 which is provided with this kind of head 41 may experience an abnormal condition of ink drop ejection (a so-called missing dot phenomenon) whereby an ink drop is not ejected from a nozzle 424 at the time that it should be ejected (ejection failure), for some reason such as ink depletion, ink thickening, an air bubble, clogging (drying out), or the like. In order to sense such an abnormal condition, it is necessary to carry out a nozzle test.

Nozzle Test

When a drive signal COM is applied to the piezoelectric actuator 422 corresponding to a nozzle 424, the pressure fluctuation that occurs at the time is followed by residual oscillation occurring inside the cavity 423 (properly speaking, free oscillation of the diaphragm 421 of FIG. 8). It is possible to detect the condition of nozzles 424 (including the condition inside the cavity 423) from the condition of this residual oscillation.

Figure 10:
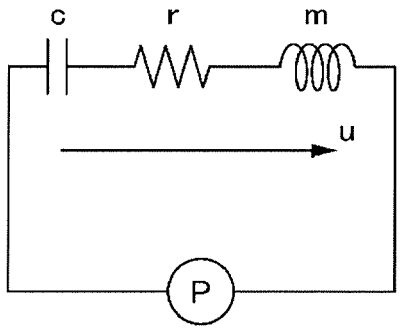
FIG. 10 is a diagram showing a computational model of simple harmonic motion on the assumption of residual oscillation of a diaphragm.

FIG. 10 is a diagram showing a computational model of simple harmonic motion on the assumption of residual oscillation of the diaphragm 421.

When a drive signal COM (driving pulse) is applied to a piezoelectric actuator 422 from the drive signal generating circuit 65, the piezoelectric actuator 422 extends and contracts in response to the voltage of the drive signal COM. The diaphragm 421 flexes in response to extension and contraction of the piezoelectric actuator 422, whereby the cavity 423 expands in volume and subsequently contracts. At this time, owing to pressure generated inside the ink chamber, some of the ink filling the cavity 423 is ejected as an ink drop from the nozzle 424. During this series of operations of the diaphragm 421, the diaphragm 421 gives rise to free oscillation (residual oscillation) at a natural resonance frequency determined by flow passage resistance r which is a function of factors such as shape of the ink supply port, ink viscosity, etc., inertance m which is a function of ink weight inside the flow passage, and compliance c of the diaphragm 421.

The computational model of residual oscillation of this diaphragm 421 is represented by pressure P, and the aforementioned inertance m, compliance C, and flow passage resistance r. Computation of step response for volume velocity u when pressure P is applied to the circuit of FIG. 10 gives the following equation.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

Figure 11:
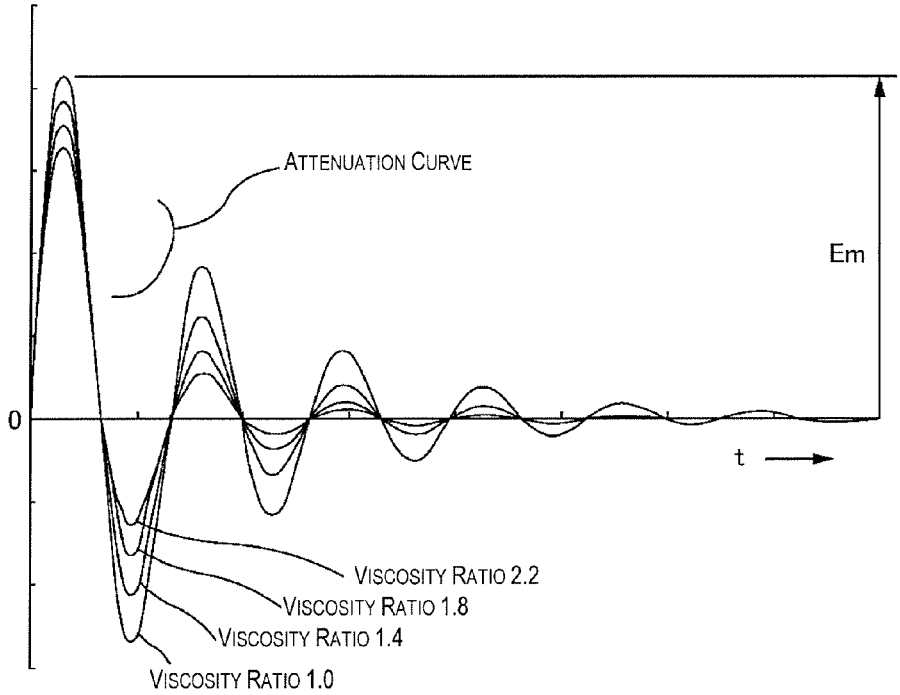
FIG. 11 is an explanatory diagram of the relationship of ink thickening and residual oscillation waveform.

FIG. 11 is an explanatory diagram of the relationship of ink thickening and residual oscillation waveform. The horizontal axis in the drawing shows time, and the vertical axis shows magnitude of residual oscillation. In the event that, for example, the ink in proximity to the nozzle 424 has dried out, the ink increases in viscosity (thickens). As the ink thickens, the flow passage resistance r increases, and the oscillation cycle and attenuation of residual oscillation are greater.

Figure 12:
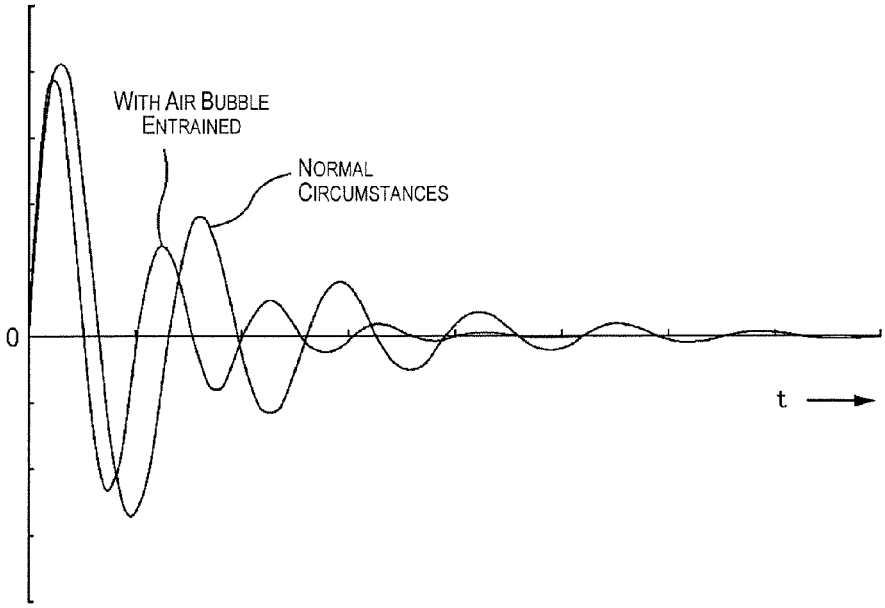
FIG. 12 is an explanatory diagram of the relationship of air bubble entrainment and residual oscillation waveform.

FIG. 12 is an explanatory diagram of the relationship of air bubble entrainment and residual oscillation waveform. The horizontal axis in the drawing shows time, and the vertical axis shows magnitude of residual oscillation.

If, for example, an air bubble has become entrained into the ink flow passage or the nozzle tip, there is a decrease in ink weight m (=inertance) commensurate with the entrained air bubble, as compared with that with the nozzle in normal condition. According to Equation (2), a decrease of m results in an increase of angular velocity ω, and therefore the oscillation cycle is shorter (the oscillation frequency is higher).

In such instances, ink may not be ejected from the nozzle 424 in normal fashion. Therefore, a missing dot may occur in the image which is printed out onto the paper S. Also, there are instances in which, even if an ink drop is ejected from the nozzle 424, the ink drop may contain a smaller amount of ink, and the flight direction (trajectory) of the ink drop may deviate such that the drop does not land at the intended location. In the present embodiment, a nozzle experiencing such problems is termed an abnormal (abnormal ejection) nozzle.

As mentioned previously, residual oscillation in an abnormal nozzle differs from residual oscillation in a normal nozzle. Accordingly, in the printer 1 of the present embodiment, a nozzle test (test of abnormal ejection) is carried out on the basis of residual oscillation inside the cavity 423 as described above, which has been sensed by the residual oscillation sensing circuit 55.

Residual Oscillation Sensing Circuit

Figure 13:
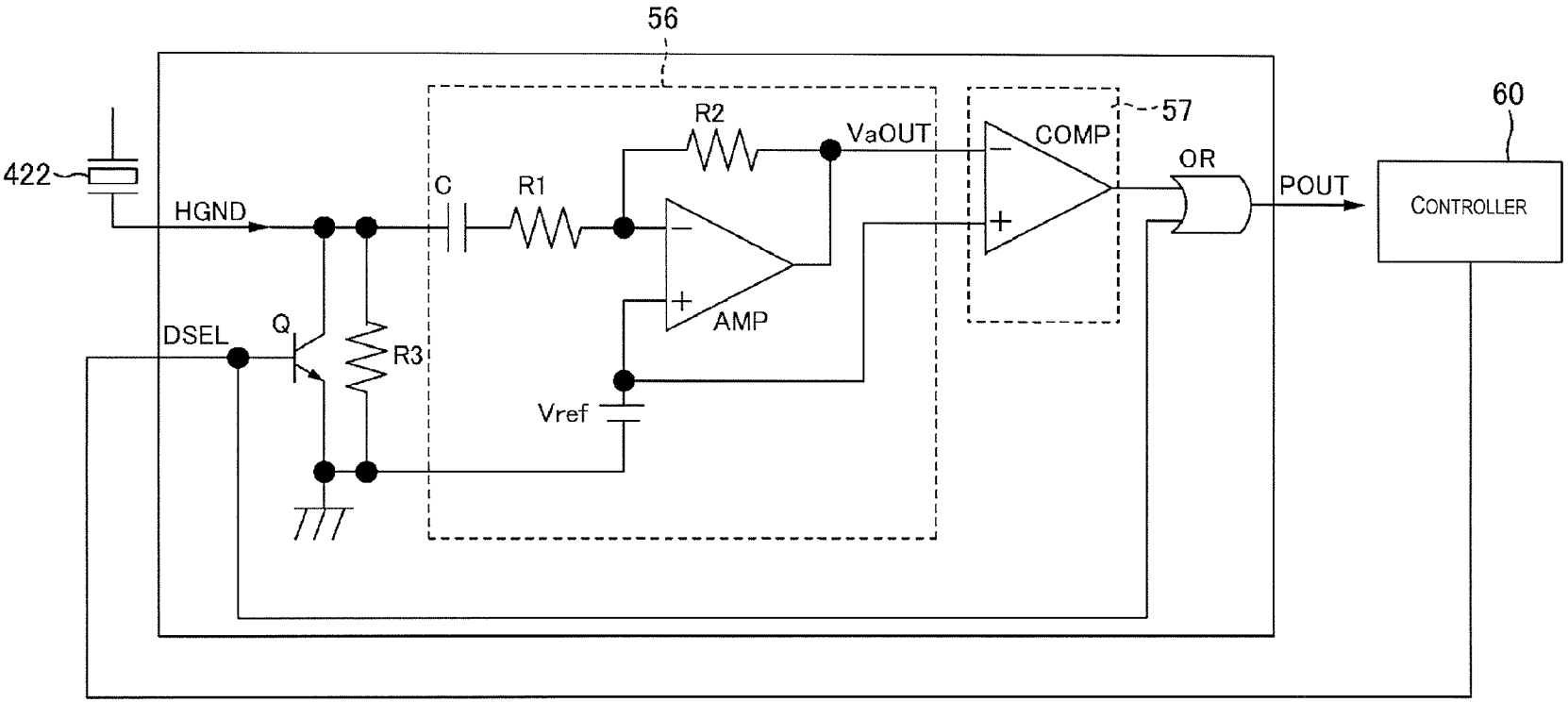
FIG. 13 is a circuit diagram showing an example configuration of a residual oscillation sensing circuit.

FIG. 13 is a circuit diagram showing an example configuration of the residual oscillation sensing circuit 55. The residual oscillation sensing circuit 55 of the present embodiment corresponds to the common ejection testing portion, and is provided in common to the nozzles of the head 41.

The residual oscillation sensing circuit 55 of the present embodiment utilizes the fact that a pressure change inside the cavity 423 is transmitted to the piezoelectric actuator 422, and more specifically, is adapted to sense a change in electromotive force (electrical voltage) produced by mechanical displacement of the piezoelectric actuator 422. This residual oscillation sensing circuit 55 has a switch (transistor Q) that alternately grounds or opens the ground terminal (HGND application end) of the piezoelectric actuator 422; an AC amplifier 56 for amplifying the AC component of residual oscillation which occurs when the ground terminal is opened subsequent to application of the drive signal COM to the piezoelectric actuator 422; a comparator 57 for comparing the amplified residual oscillation VaOUT to a reference voltage Vref; and an OR circuit OR that has the output of the comparator 57 and a gate signal DSEL from the transistor Q as inputs, and that outputs the logical sum thereof. Of these components, the AC amplifier 56 is composed of a capacitor C for eliminating the DC component, and an arithmetic unit AMP that inverts at gain determined by two resistors R1, R2 with reference to the potential of the reference voltage Vref. A resistor R3 is provided for suppressing sudden voltage change when the transistor Q switches ON and OFF. The transistor Q corresponds to the second switch.

By virtue of the above configuration, when the gate voltage (gate signal DSEL) of the transistor Q in the residual oscillation sensing circuit 55 goes to high level (herein also denoted as H level), the transistor Q goes ON, the ground terminal (corresponding to the other terminal) of the piezoelectric actuator 422 assumes the grounded state, and a drive signal COM is supplied to the piezoelectric actuator 422. Conversely, when the gate voltage (gate signal DSEL) of the transistor Q in the residual oscillation sensing circuit 55 goes to low level (herein also denoted as L level), the transistor Q goes OFF, and the electromotive force of the piezoelectric actuator 422 flows to the residual oscillation sensing circuit 55. Sensing of residual oscillation is carried out by the residual oscillation sensing circuit 55, whereupon the sensed results are output as a pulse POUT. The reference numeral HGND in the drawing indicates the signal line (ground line) leading to the ground terminal of the piezoelectric actuator 422.

Figure 14:
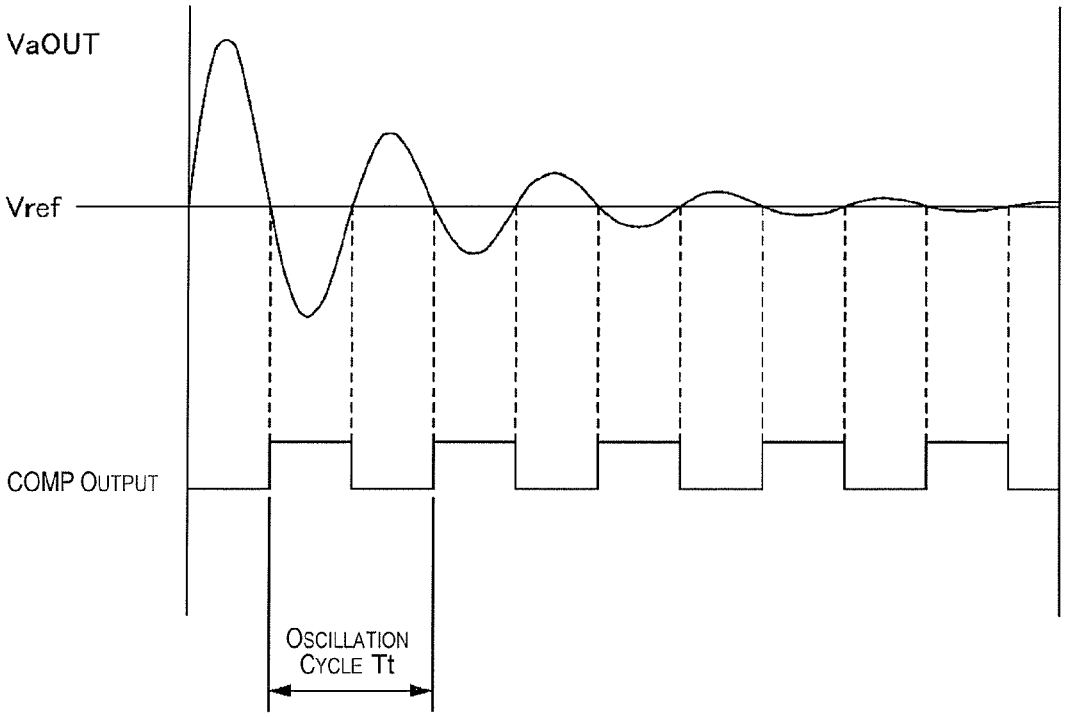
FIG. 14 is a diagram showing an example relationship of input and output of a comparator of a residual oscillation sensing circuit.

FIG. 14 is a diagram showing an example relationship of input and output of the comparator 57 of the residual oscillation sensing circuit 55.

The reference voltage Vref is applied to the non-inverting input terminal (+terminal) of the comparator 57, while the residual oscillation VaOUT is applied to the inverting input terminal (−terminal). If the voltage at the +terminal (Vref) is greater than the voltage at the −terminal (VaOUT), the comparator 57 outputs H level, or if the voltage at the +terminal (Vref) is less than the voltage at the −terminal (VaOUT), the comparator 57 outputs L level. Therefore, a pulse (COMP output) reflecting oscillation of the residual oscillation VaOUT is output as shown in the drawing. According to the present embodiment, nozzles 424 are tested on the basis of the pulse cycle (oscillation cycle Tt) of this pulse output (COMP output).

Per FIG. 11, the pulse cycle (oscillation cycle Tt) is unchanged with respect to thickening. Accordingly, in this case, the test is carried out by examining the pulse count. For example, if thickening is more advanced, pulse attenuation is greater than when thickening is less advanced, and therefore the pulses (i.e., pulses sensed by the residual oscillation sensing circuit 55) are fewer in number. Therefore, thickening can be tested on the basis of pulse count.

If the residual oscillation sensing circuits 55 are respectively provided to the nozzles 424 and testing is performed by ejection testing portions corresponding to individual nozzles 424, a resultant problem is that the number of residual oscillation sensing circuits 55 becomes quite large (a number equal to the number nozzles 424 is required). On the other hand, if the residual oscillation sensing circuit 55 is provided in common to the nozzles 424, a resultant problem is that a specific nozzle 424 cannot be tested while the plurality of nozzles 424 are being driven for printing, or the like.

Thus, according to the present embodiment, in the manner described below, the residual oscillation sensing circuit 55 is provided in common to the plurality of nozzles 424, and a testing period is provided within the ejection cycles of the drive signal (following the drive pulse). In so doing, a specific nozzle 424 (nozzle to be tested) may be tested by the common residual oscillation sensing circuit 55, even at times when the plurality of nozzles 424 are being driven for the purpose of printing or flushing.

Head Controller Configuration

Figure 15:
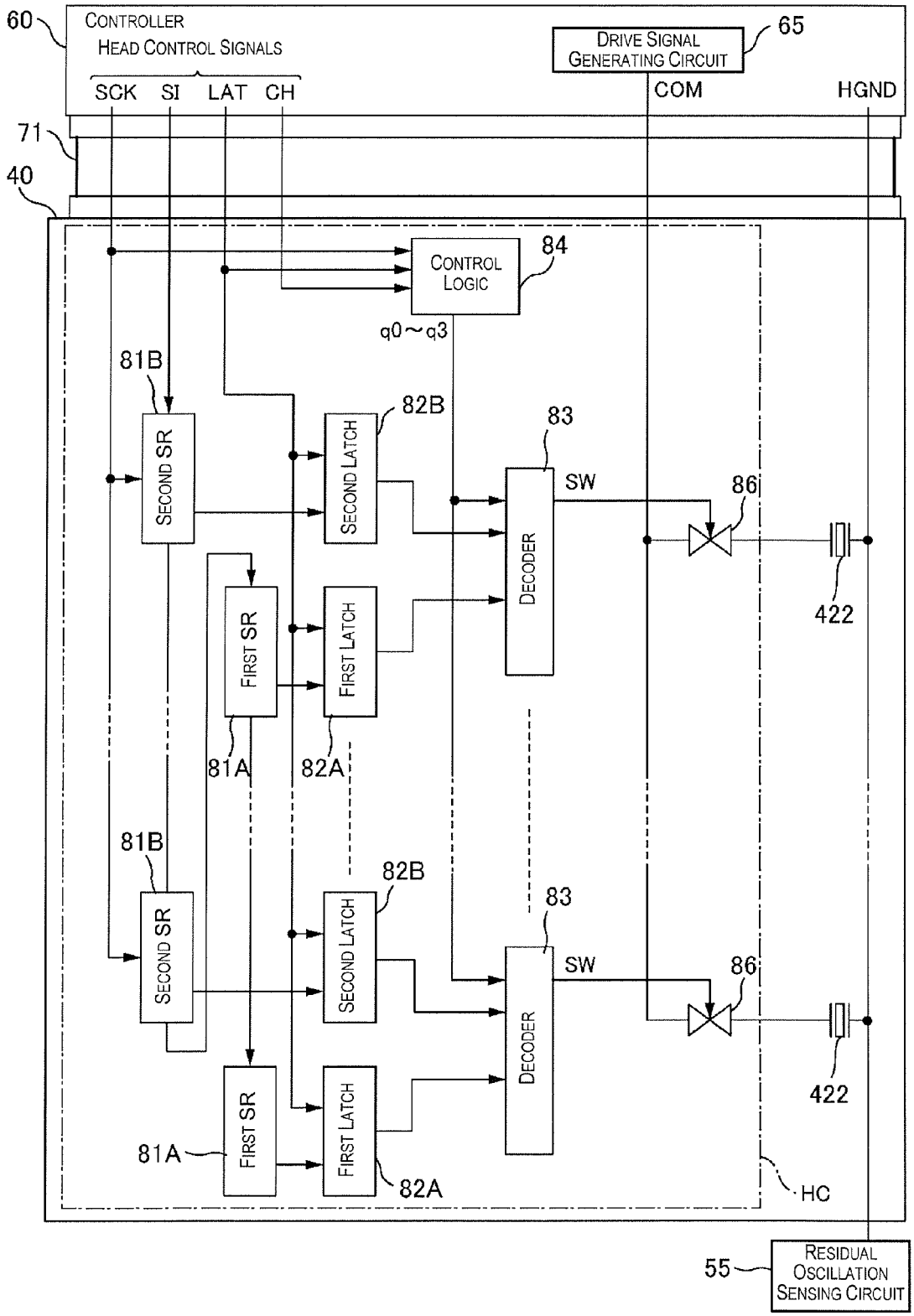
FIG. 15 is an explanatory diagram of a configuration of a head controller HC.
Figure 16:
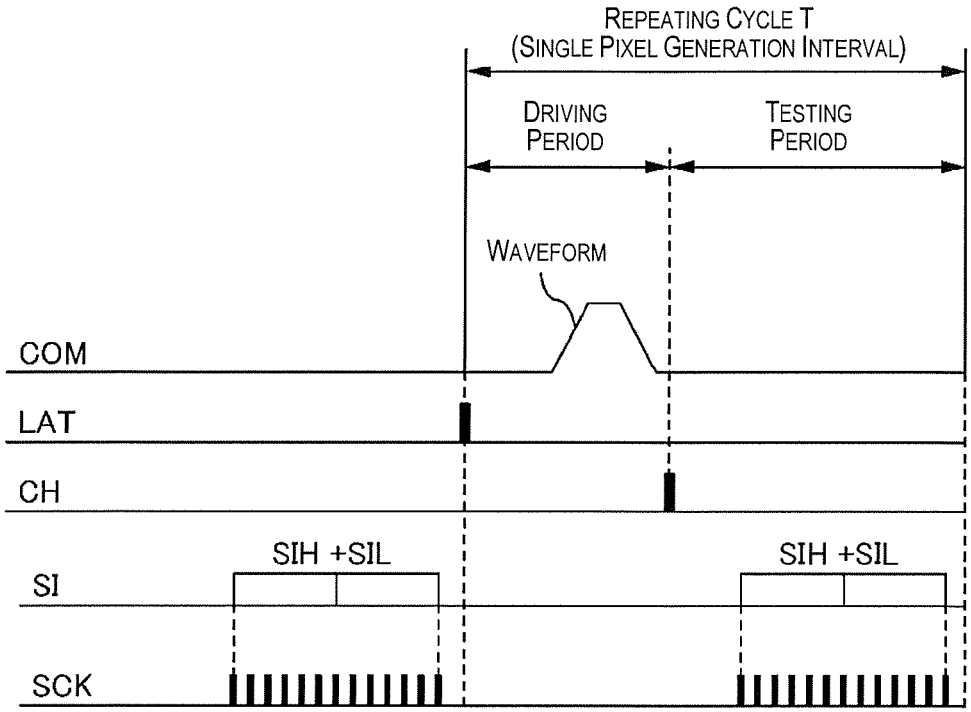
FIG. 16 is an explanatory diagram of timing of signals.

FIG. 15 is an explanatory diagram of a configuration of a head controller HC of the head unit 40. FIG. 16 is an explanatory diagram of timing of signals.

The head controller HC shown in FIG. 15 has a first shift register 81A, a second shift register 81*b*, a first latch circuit 82A, a second latch circuit 82B, a decoder 83, a control logic 84, and a switch 86 (corresponding to the first switch). With the exception of the control logic 84, these parts (i.e., the first shift register 81A, second shift register 81*b*, first latch circuit 82A, second latch circuit 82B, decoder 83, and switch 86) are respectively provided for each of the piezoelectric actuators 422 (each of the nozzles 424).

The residual oscillation sensing circuit 55 of the present embodiment is provided in common for the nozzles 424; and signal lines (ground lines HGND) leading to the ground terminal end of the piezoelectric actuators 422 are input to the residual oscillation sensing circuit 55.

According to the present embodiment, the transmission lines in the flexible cable 71 include transmission lines for the drive signal COM, a latch signal LAT, a channel signal CH, pixel data SI, and a transfer clock SCK, and a ground line HGND. The drive signal COM, the latch signal LAT, the channel signal CH, the pixel data SI, and the transfer clock SCK are transmitted from the controller 60 to the head controller HC via the transmission lines of the flexible cable 71. These signals are described below.

The latch signal LAT is a signal that indicates a repeating cycle T (representing a period in which the head 41 travels one pixel interval). The latch signal LAT is generated by the controller 60 on the basis of a signal from the linear encoder 51, and is input to the control logic 84 and to the latch circuits (the first latch circuit 82A and the second latch circuit 82B).

The channel signal CH is a signal that indicates an interval for application of a driving pulse contained in the drive signal COM to a piezoelectric actuator 422. The channel signal CH is generated by the controller 60 on the basis of a signal the linear encoder 51, and is input to the control logic 84.

The pixel data SI is a signal indicating whether or not to form a dot on each pixel (i.e., whether to eject ink from the nozzles 424). In the present embodiment, the pixel data Si also represents the scanning period of the nozzles 424. The pixel data SI is composed of 2 bits for each one nozzle 424. For example, if there are 64 nozzles, 2 bit×64 pixel data Si is sent to the controller 60 in each of the repeating cycles T. The pixel data SI is input to the first shift register 81A and the second shift register 81B synchronously with the transfer clock SCK.

The transfer clock SCK is a signal used when setting pixel data SI or a channel signal CH sent from the controller 60 in the control logic 84 or in the shift registers (the first shift register 81A or the second shift register 81B).

As shown in FIG. 16, the drive signal COM of the present embodiment includes two periods, namely, a driving period and a testing period, in the course of a repeating cycle T. Of these, the driving period contains a waveform for application to the piezoelectric actuators 422 at times of dot formation (at times of ink ejection). The testing period indicates a period in which nozzle testing is performed; during this testing period, the drive signal COM is constant.

The drive signal COM is input respectively to the switches 86 which are provided to each of the piezoelectric actuators 422. Based on the pixel data SI, the switches 86 perform ON/OFF control to control whether the drive signal COM is applied to the piezoelectric actuators 422. Through this ON/OFF control, a portion of the drive signal COM can be selectively applied to certain piezoelectric actuators 422. Control for the purpose of applying the periods of the drive signal COM to the piezoelectric actuators 422 will be discussed in detail later.

The discussion turns next to signals generated by the head controller HC. In the head controller HC, selection signals q0 to q3, a switch control signal SW, and an application signal are generated.

The selection signals q0 to q3 are generated by the control logic 64 on the basis of the latch signal LAT and the channel signal CH. The selection signals q0 to q3 so generated are then input respectively to the decoder 83 provided to each of the piezoelectric actuators 422.

The switch control signal SW indicates any one of the selection signals q0 to q3 selected by the decoder 83 on the basis of pixel data (2-bit) that is latched in the latch circuits (the first latch circuit 82A or second latch circuit 82B). A switch control signal SW generated by a decoders 82 is input respectively to the corresponding switch 86.

The application signal is output from a switch 86 on the basis of the drive signal COM and the switch control signal SW. This application signal is applied to the piezoelectric actuator 422 respectively corresponding to the switch 86.

Operation of Head Controller HC

The head controller HC performs control for the purpose of ejecting ink on the basis of the pixel data SI from the controller 60. Specifically, the head controller HC performs ON/OFF control of the switches 86 on the basis of the print data, and selectively applies the necessary segments (periods) of the drive signal COM to the piezoelectric actuators 422. In other words, the head controller HC controls actuation of the piezoelectric actuators 422. In the present embodiment, pixel data SI is composed of two bits. This pixel data SI is sent to the head 42 synchronously with the transfer clock signal SCK. Additionally, high order bit groups of the pixel data SI are set in the first shift register 81A, and low order bit groups are set in the second shift register 81B. The first shift register 81A is electrically connected to the first latch circuit 82A, and the second shift register 81B is electrically connected to the second latch circuit 82B. When the latch signal LAT from the controller 60 goes to H level, the first latch circuits 82A latch the high order bit (SIH) of the corresponding pixel data SI while the second latch circuits 82B latch the low order bit (SIL) of the pixel data SI. The pixel data SI latched by the first latch circuit 82A and the second latch circuit 82B (i.e., combinations of high order bits and the low order bits) are respectively input to the decoders 83. In response to the pixel data SI latched in the first latch circuits 82A and the second latch circuits 82B, the decoders 83 select a single selection signal from among the selection signals q0 to q3 output by the control logic 84 (e.g., the selection signal q1), and output the selected selection signal as a switch control signal SW. The switches 86 are switched ON or OFF according to the switch control signals SW, and the necessary segments (periods) of the drive signal COM are selectively applied to the piezoelectric actuators 422.

Relationship of Dot Formation by Pixel Data to Nozzle Testing

Figure 17:
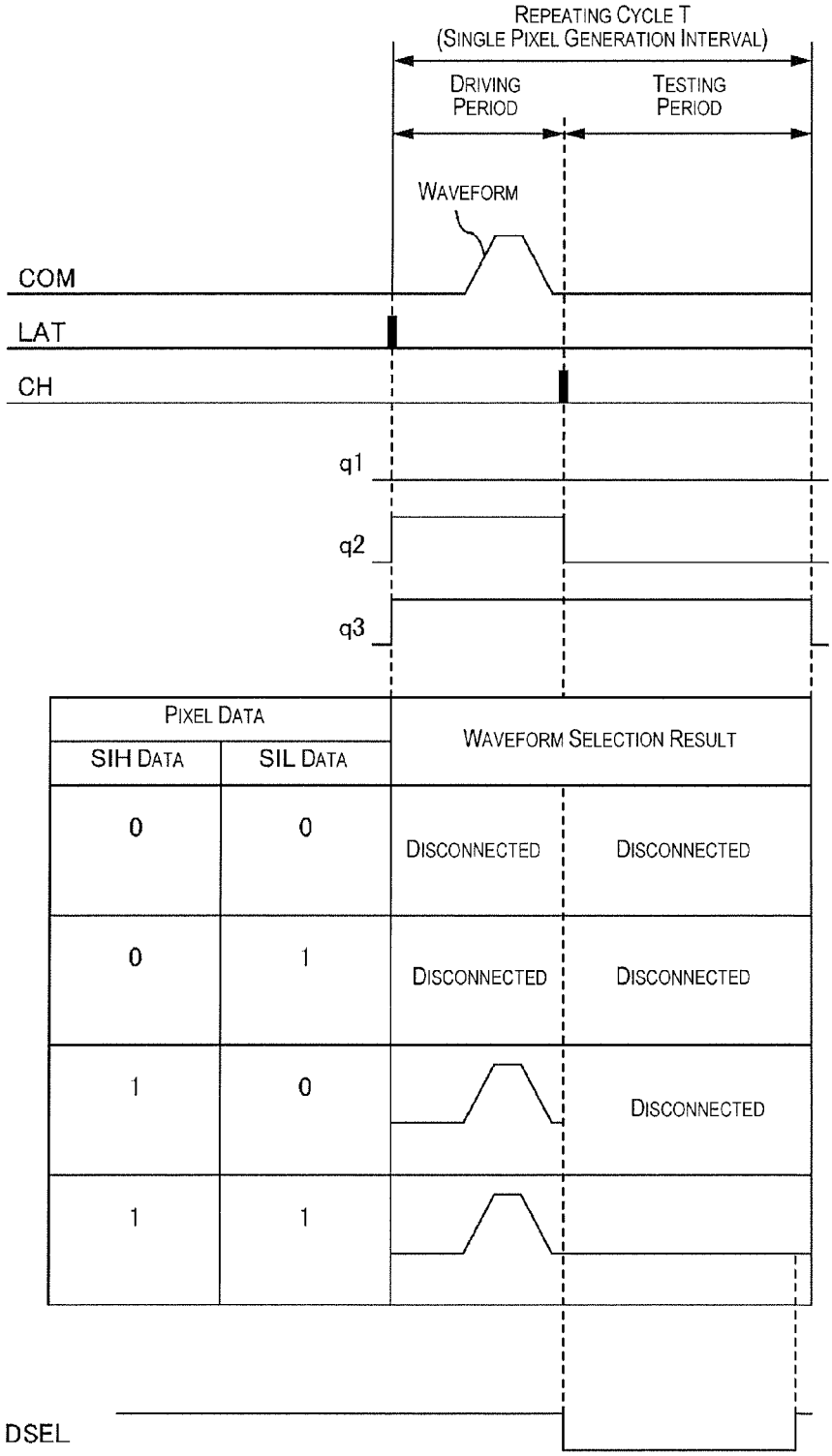
FIG. 17 is a diagram showing a relationship of a drive signal COM and pixel data SI.

FIG. 17 is a diagram showing a relationship of the drive signal COM and pixel data SI.

First, a situation in which the highest order bit (SIH) of the pixel data SI is 0 (situations of "00" and "01") will be discussed. In this situation, the selection signal q1 is output as the switching signal SW. Therefore, the switches 86 go to the "off" (disconnected) state in the repeating cycle T, and as a result the drive signal COM is not applied to the piezoelectric actuators 422. In this situation, ink drops are not ejected from the nozzles 424, nor is nozzle testing performed.

The description turns next to a situation in which the pixel data SI is "10." In a situation where pixel data of "10" is currently latched, the selection signal q2 is output as the switching signal SW. Therefore, the switches 86 go to the "on" state in the driving period, and the switches 86 go to the "off" state in the testing period. As a result, in the driving period the waveform of the drive signal COM is applied to the piezoelectric actuators 422, and ink drops are ejected from the nozzles 424. During the testing period, application of the drive signal COM to the piezoelectric actuators 422 is interrupted.

The description turns next to a situation in which the pixel data SI is "11." In a situation where pixel data of "11" is currently latched, the selection signal q3 is output as the switching signal SW. Therefore, the switches 86 go to the "on" state in both the driving period and the testing period. As a result, in the driving period the waveform of the drive signal COM is applied to the piezoelectric actuators 422 and ink is ejected from the nozzles 424. The drive signal COM (constant voltage) is applied to the piezoelectric actuators 422 in the testing period as well.

As shown in FIG. 17, the gate signal DSEL (the control signal of the transistor Q or the residual oscillation sensing circuit 55) is L level only during testing periods, and is H level at other times. Specifically, as seen from FIG. 13, in periods other than testing periods, the transistor Q of the residual oscillation sensing circuit 55 is ON and the ground terminals of the piezoelectric actuators 422 are grounded. In testing periods, on the other hand, the transistor Q of the residual oscillation sensing circuit 55 is OFF. During testing periods, the drive signal COM is constant, and is applied to one end of the piezoelectric actuator 422 of the nozzle to be tested only. Therefore, the electromotive force of the piezoelectric actuator 422 corresponding to the nozzle to be tested flows to the residual oscillation sensing circuit 55.

Additionally, the output of the OR circuit OR of FIG. 13 (in other words, the output of the residual oscillation sensing circuit 55) is always H level at times other than testing periods, and during testing periods becomes a signal that reflects the output of the comparator 17. Specifically, when the COMP output is H level, POUT is also H level; and when the COMP output is L level, POUT is also L level. Therefore, during testing periods, the oscillation cycle Tt of FIG. 14 may be sensed from the output (POUT) of the residual oscillation sensing circuit 55. Nozzle testing can then be carried out on the basis of the sensed results.

According to the present embodiment, through decoding of pixel data SI in this way, information indicating nozzle test on/off status may be obtained in addition to information indicating dot on/off status. Therefore, the number of lines running from the controller 60 to the head controller HC can be reduced, as compared with the case where information indicating nozzle testing on/off status is transmitted separately from information indicating dot on/off status.

Figure 18:
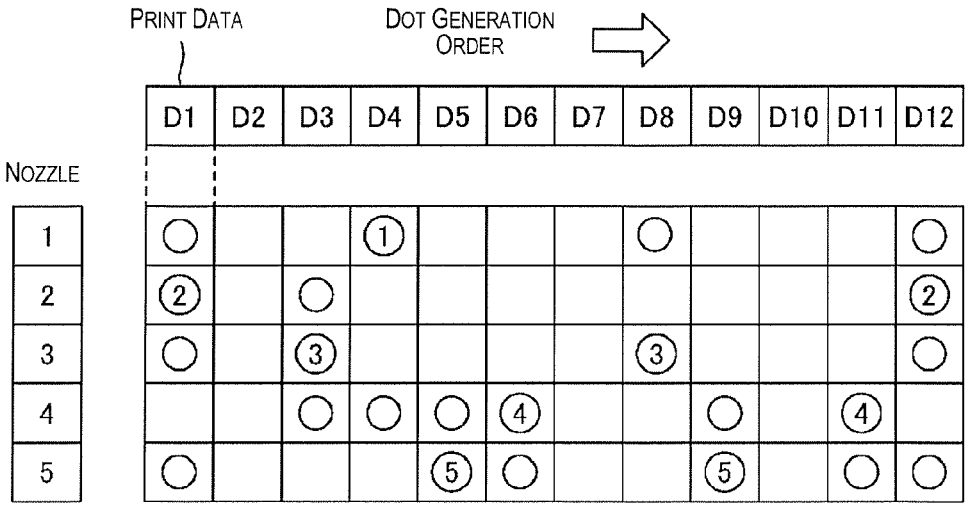
FIG. 18 is a diagram showing an application example of nozzle testing during printing.

Application Example of Nozzle Test During Printing
Assignment of Nozzles to be Tested to Print Data FIG. 18 is a diagram showing an application example of nozzle testing during printing.

To simplify description, only a single nozzle row among the plurality of nozzle rows is shown, and the number of nozzles 424 of the nozzle row (hereinafter simply called nozzles) is assumed to be five. The grid diagram to the right side of the nozzles in FIG. 18 indicates print data for a given pass (in this instance, the initial pass), and individual cells correspond to pixels.

In the drawing, data (pixels) which is lined up in rows in the conveyance direction (row D1 to row D12) correspond to nozzles of the respective rows. Cells with a circle inside indicate data for ejection of ink, while cells without a circle represent data for non-ejection of ink. Data with a numeral inside a circle indicates data for performing nozzle testing; the numeral corresponds to the number of the nozzle (nozzle number).

The controller 60 of the present embodiment expands the print data (e.g., print data equivalent to one pass) that was received from the printer driver, and on the basis of this print data performs assignment of nozzles to be tested. This assignment process generates 2-bit data indicating dot on/off states and ejection testing of nozzles, from 1-bit data indicating dot on/off states.

According to the present embodiment, assignment of nozzles to be tested is performed in the following order of precedence.

(1) Situations where Untested Nozzles are Present

First, in situations where untested nozzles are present, a nozzle to be tested is selected from among the untested nozzles, giving precedence to nozzles with lower ejection frequency (see row D1, row D2, row D3).

For example, in FIG. 18, all of the nozzles in row D1 which initiates printing are untested nozzles. Also, in row D1, ink is ejected from nozzles #1 to #3 and nozzle #5. Specifically, in row D1, the candidates for nozzles to be tested are nozzles #1 to #3 and nozzle #5. From the drawing, it may be seen that the ejection frequency of nozzles in this pass is: nozzle #1 four times; nozzle #2 three times; nozzle #3 four times; and nozzle #5 six times. Consequently, the controller 60 selects as the nozzle to be tested nozzle #2, which is the candidate with the lowest ejection frequency in row D1.

In row D3, ink is ejected from nozzles #2 to #4. Of these, #2 has been selected as the nozzle to be tested in row D1. Therefore, the candidates for the nozzle to be tested are the untested nozzles, namely, nozzle #3 and nozzle #4. From the drawing, it may be seen that the ejection frequency of nozzles in this pass is: nozzle #3 four times; and nozzle #4 six times. Consequently, the controller 60 selects nozzle #3 in row D3 as the nozzle to be tested.

Analogously, in row D4, nozzle #1 and nozzle #4 are candidates for the nozzle to be tested, and nozzle #1, having the lower ejection frequency, is selected.

If nozzles to be tested are selected randomly, a risk is presented that there may be few opportunities to perform ejection testing of nozzles having low ejection frequency. The reason is that since only nozzles that ejected ink in each row become candidates for nozzle testing, it is difficult for nozzles having low ejection frequency to become candidates for nozzle testing (the frequency of becoming a candidate is low). Therefore, a risk is presented that, depending on the print data, nozzle testing may not be performed on nozzles having low ejection frequency.

In contrast, according to the present embodiment, through selection from among untested nozzles while giving precedence to nozzles having low ejection frequency based on print data, nozzles having low ejection frequency can be tested in reliable fashion.

(2) Situations where Untested Nozzles Having Identical Ejection Frequency are Present Next, in a situation where a plurality of untested nozzles are present but have identical ejection frequency, selection is made giving precedence to a longer non-printing interval (period where no ink is ejected) (see row D5). The reason is that a longer period in which no ink is ejected is associated with higher likelihood of failed ejection due to drying out of the ink, or other reasons. By selecting a nozzle having a longer period of no ejection of ink, nozzle testing can be carried out in a manner mindful of the effects of drying out.

For example, in row D5, nozzle #4 and nozzle #5 eject ink. Nozzle #4 and nozzle #5 have not been tested up to this point (they are untested nozzles). Specifically, the candidates for nozzles to be tested are nozzle #4 and nozzle #5. From the drawing, it may be seen that the ejection frequency for both nozzle #4 and nozzle #5 is six. In this situation, the nozzle having the longer period of no ejection of ink is selected. From the drawing, it may be seen that nozzle #4 ejected ink in row D4. Meanwhile, nozzle #5 has not ejected ink since ejecting ink row D1. Consequently, in row D5, nozzle #5, which has the longest period of no ejection of ink, is selected as the nozzle to be tested.

(3) Situations where No Untested Nozzles are Present

For example, in situations where nozzle testing has cycled through once for each nozzle, or in situations where the nozzles that form dots are all nozzles that have already been tested, precedence is given to longer interval between testing (see row D8, row D9, row D11, row D12). This is because a longer interval between testing is associated with higher likelihood of failed ejection due to drying out of the ink or other reasons. In situations where no untested nozzles are present, by giving precedence in this way to a nozzle having a longer interval between testing, nozzle testing can be carried out in a manner that takes the effects of drying out into account.

In FIG. 18, testing of each nozzle in row D6 (nozzles #1 to #5) has already cycled through once. Specifically, there are no longer any untested nozzles. Therefore, from this point on, nozzles having a longer interval between testing are given precedence as described above.

For example, in row D8, nozzle #1 and nozzle #3 are candidates for the nozzle to be tested. From the drawing, it may be seen that ejection testing for nozzle #1 was performed in row D4, whereas ejection testing for nozzle #3 was performed in row D3. That is, nozzle #3 has experienced a longer interval since the previous test. Therefore, in row D8, nozzle #3 is selected as the nozzle to be tested.

In row D9, nozzle #4 and nozzle #5 are candidates for the nozzle to be tested. From the drawing, it may be seen that ejection testing for nozzle #4 was performed in row D6, whereas ejection testing for nozzle #5 was performed in row D5. That is, nozzle #5 has experienced a longer interval since the previous test. Therefore, in row D9, nozzle #9 is selected as the nozzle to be tested.

Analogously, nozzle #4 in row D11 and nozzle #2 in row D12 are respectively selected as the nozzle to be tested.

The controller 60 assigns data indicating a nozzle to be tested to the print data (1-bit data) that was received from the printer driver. Specifically, the print data contains 1-bit data (highest order bit data (SIH)) for each pixel, of either a "1" indicating a dot "on" state (a circle in the drawing) or a "0" indicating a dot "off" state to which data is assigned lowest order bit data of either a "1" in the case of a nozzle to be tested or a "0" in the case of a nozzle not to be tested. 2-bit pixel data SI is generated in this manner.

For example, in the situation of FIG. 18, the print data (1-bit data) of row D1 is "0" for nozzle #4 and "1" for nozzles other than nozzle #4. The controller 60 assigns a "1" as lowest order bit data to the data of the nozzle to be tested of row D1 (nozzle #2). For the other nozzles, a "0" is assigned as lowest order bit data. Specifically, the pixel data SI for nozzle #2 of row D1 is "11," the pixel data SI for nozzles #1, #2, and #5 is "10," and the pixel data SI for nozzle #4 is "00." Nozzles to be tested are assigned analogously for other rows as well.

Dot Formation and Nozzle Testing

During printing, dot formation and nozzle testing are performed based on the print data of FIG. 18.

For example, as stated above, the pixel data SI of row D1 is "11" for nozzle #2, "10" for nozzles #1, #2, and #5, and "00" for nozzle #4.

Therefore, as shown in FIG. 17, the switches 86 corresponding to nozzles #1 to #3 and #5 go "on" of the drive signal COM during the driving period, and the waveform of the drive signal COM is applied to the piezoelectric actuators 422. Thereby, the piezoelectric actuators 422 are driven and an ink ejection operation is performed. During this period, the switch 86 corresponding to nozzle #4 is "off", and the drive signal COM is not applied to the piezoelectric actuator 422 corresponding to nozzle #4. Therefore, ink is not ejected from nozzle #4.

During the subsequent testing period, only the switch 86 corresponding to the nozzle to be tested (nozzle #2) goes "on". The constant drive signal COM is thereby applied to one end of the piezoelectric actuator 422 corresponding to nozzle #2. During the testing period, the gate signal DSEL of the residual oscillation sensing circuit 55 goes to L level and the transistor Q of the residual oscillation sensing circuit 55 goes "off." The electromotive force of the piezoelectric actuator 422 thereby flows to the residual oscillation sensing circuit 55, and nozzle testing is performed on the basis of residual oscillation subsequent to ink ejection operation of nozzle #2.

Likewise, for other rows as well, based on print data, an ink ejection operation and nozzle testing of a nozzle to be tested which has been selected from among the nozzles that ejected ink are performed in each repeating cycle T.

Application Example of Nozzle Testing During Flushing

Figure 19:
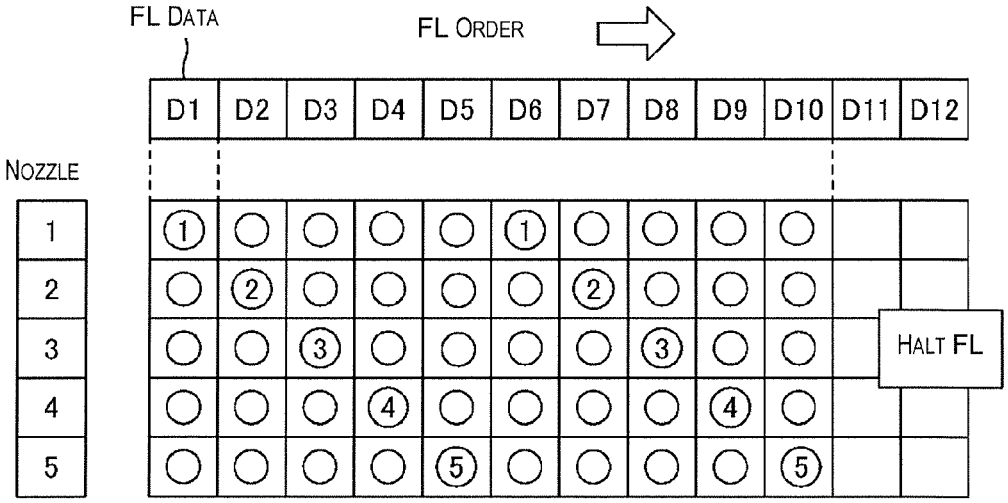
FIG. 19 is a diagram showing an application example of nozzle testing during flushing.

FIG. 19 is a diagram showing an application example of nozzle testing during flushing.

Flushing refers to an operation of continuously ejecting ink from nozzles in order to restore ejection capability of the nozzles.

In FIG. 19, as in FIG. 18, to simplify description, only one of the plurality of nozzle rows is shown, and the number of nozzles is assumed to be five. The conventions for description of FIG. 19 are the same as for FIG. 18.

During flushing, ink is ejected from all of the nozzles, and therefore in this example, the nozzle to be tested is selected in order of nozzle number.

For example, in row D1, nozzle #1 is selected as the nozzle to be tested, and in row D2 nozzle #2 is selected as the nozzle to be tested. In row D3, nozzle #3 is selected as the nozzle to be tested. In the flow described below (FIG. 21), nozzle testing takes place during flushing of only a nozzle or nozzles that have experienced an abnormal condition of ink thickening during printing.

In this situation, in row D1, "10" is set as the pixel data SI of nozzles #2 to #5. In so doing, only ink ejection operations according to the waveform are performed by nozzles #2 to #5 in the driving period of the drive signal COM. Also, in row D1, "11" is set as the pixel data SI of nozzle #1. In so doing, an ink ejection operation according to the waveform is performed by nozzle #1 in the driving period of the drive signal COM, and subsequently, nozzle testing based on residual oscillation is performed in the testing period.

The process proceeds analogously thereafter, while the nozzle to be tested in each row is changed. For example, in row D2, only the pixel data SI of nozzle #2 is set to "11," and nozzle testing of nozzle #2 is performed. In row D3, only the pixel data SI of nozzle #3 is set to "11," and nozzle testing of nozzle #3 is performed.

In the drawing, after cycling twice through testing of each nozzle (#1 to #5), the nozzle test results are designated as normal, and flushing is halted.

In this way, during flushing as well, nozzle testing of individual nozzles can be performed with the residual oscillation sensing circuit 55 which is provided in common to all of the nozzles. According to the present embodiment, if test results are normal for all of the nozzles, flushing may be terminated midway through the flushing operation. Ink consumption may be reduced thereby.

Nozzle Testing Process

Figure 20:
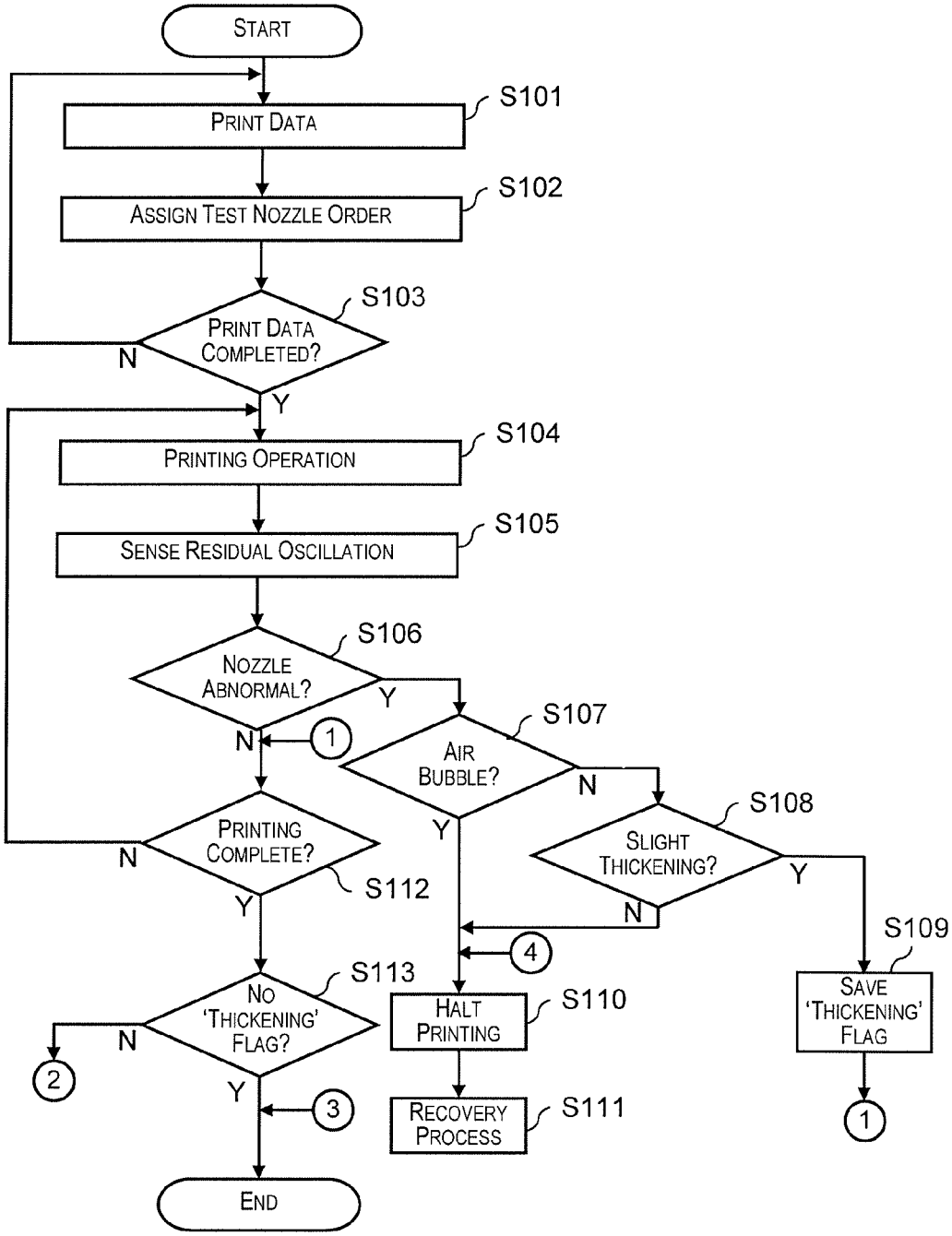
FIG. 20 is a flow diagram showing a process of nozzle testing (during printing).
Figure 21:
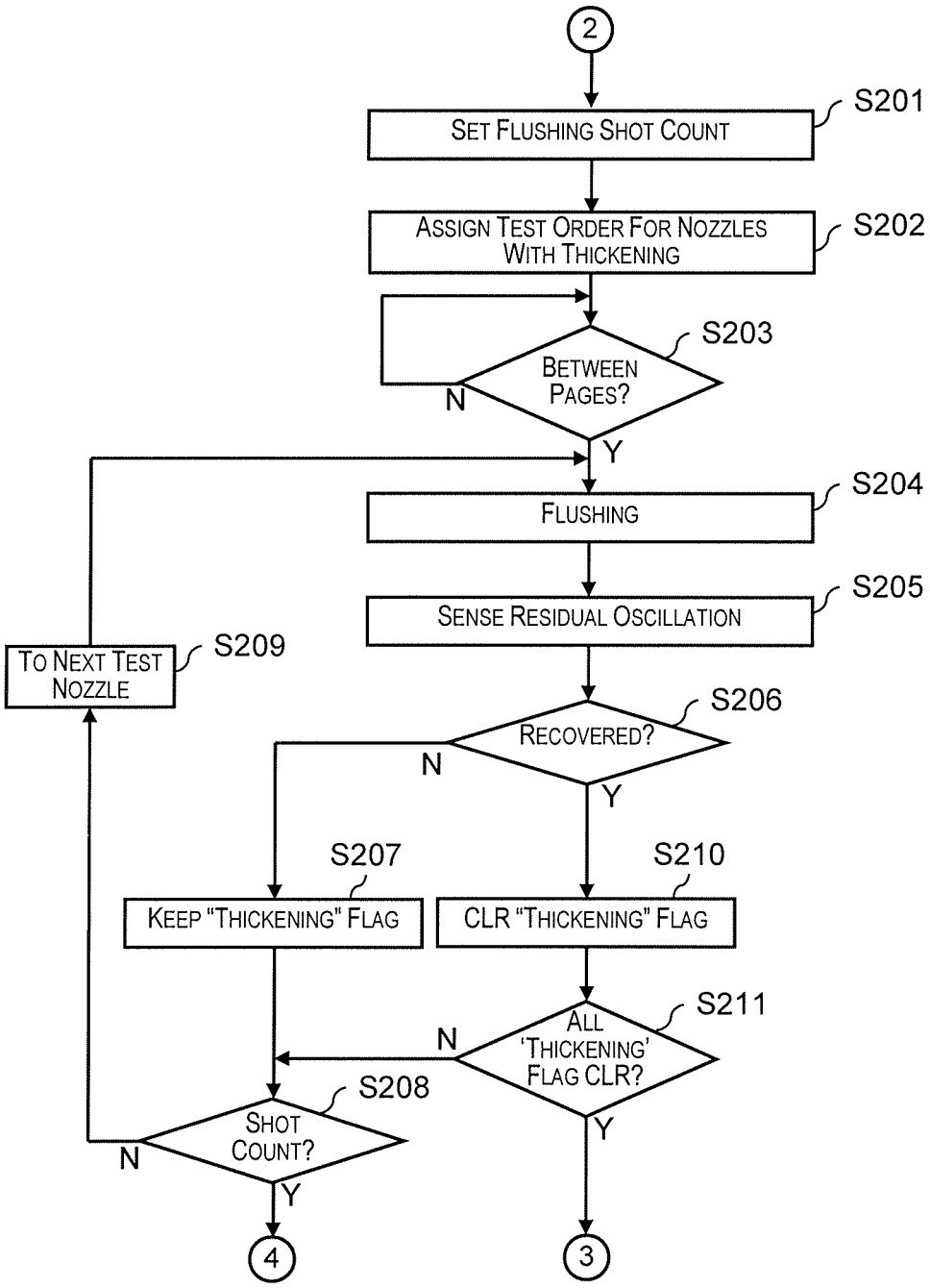
FIG. 21 is a flow diagram showing a process of nozzle testing (during flushing).

FIG. 20 and FIG. 21 are flow diagrams showing examples of the nozzle testing process according to the present embodiment.

FIG. 20 shows the flow during printing, and FIG. 21 shows the flow during flushing.

In FIG. 20, first, the controller 60 receives the print data from the printer driver (S101) and performs assignment of nozzles to be tested in the manner described above (S102). In this way, pixel data SI which is 2-bit data is generated from the 1-bit data. When the process of assigning nozzles to be tested is completed for the print data (Y in S103), a printing operation is performed on the basis of the print data (S104).

Specifically, on the basis of the pixel data SI and the selection signals q0 to q3, each of the decoders 83 of the head controller HC generates, on an individual nozzle basis, a switching signal SW which includes drive pulse (waveform) selection information and testing period selection information. The head controller HC then turns "on" the corresponding switches 86 with the switching signal SW in accordance with the pixel data SI during the drive period of the repeating cycle T. In this way, the waveform of the drive signal COM is selectively applied to piezoelectric actuators 422 to perform ink ejection operations.

During the testing period as well, the head controller HC turns "on" or "off" the corresponding switches 86 with the switching signal SW (testing period selection information). Here, only the switch 86 corresponding to the nozzle to be tested goes "on", while the switches 86 other than that corresponding to the nozzle to be tested go "off." In this way, application of the drive signal COM to the piezoelectric actuator 422 is interrupted for nozzles other than the nozzle to be tested. Further, during the testing period, the controller 60 brings the gate select signal DSEL to the residual oscillation sensing circuit 55 to L level, and the transistor Q of the residual oscillation sensing circuit 55 goes "off." In so doing, electromotive force of the piezoelectric actuator 422 corresponding to the nozzle to be tested flows to the residual oscillation sensing circuit 55. In this way, residual oscillation of the nozzle to be tested is sensed by the residual oscillation sensing circuit 55 (S105).

On the basis of the sensed results (pulse POUT) of the residual oscillation sensing circuit 55, the controller 60 then decides whether an abnormal condition of a nozzle exists (S106).

If an abnormal condition exists in a nozzle (Y in S106), it is decided whether the cause of the abnormal condition of the nozzle is an air bubble (S107). Specifically, it is decided whether the cause of the abnormal condition is one based on the oscillation cycle Tt. If an air bubble is not the cause (N in S107), it is further decided whether the cause of the abnormal condition of the nozzle is thickening of the ink (S108). Specifically, it is decided whether the cause of the abnormal condition is one based on the pulse count. In a situation where thickening of the ink is the cause (Y in S108), a "Thickening" flag is saved, for example, to the memory 63 (S109), and a decision as to whether printing has completed is performed (S112). In a situation where, in Step S107, the controller 60 has decided that an air bubble is the cause (Y in S107) and in a situation where, in Step S108, it has been decided that thickening was not the cause (N in S108), printing is halted (S110) and a recovery process (e.g., cleaning or the like) is performed (S111).

In Step S112, if it is decided that printing has not completed (N in S112), the process returns to Step S104.

In Step S112, if it is decided that printing has completed (Y in S112), a decision as to whether there is no "Thickening" flag is performed (S113).

If there is no "Thickening" flag (Y in S113), the process terminates. If there is a Thickening" flag (N in S113), the flow depicted in FIG. 21 (flushing) is executed.

According to the flushing process shown in FIG. 21, first, a shot count for flushing is established in advance (S201). In the present embodiment, it is assumed that nozzle testing is performed only on nozzles for which a "Thickening" flag has been saved. Specifically, an ejection frequency for the nozzles is established in accordance with the number of "Thickening" flags. For example, in a situation where "Thickening" flags have been saved for five nozzles, print data equivalent to five shots (nozzle ejection five times) is established. A nozzle testing order of flushing for individual shots is assigned to the established print data (flushing data) as well (S202). Here, if "Thickening" flags have been saved for a plurality of nozzles, the nozzles to be tested are assigned in order of the nozzle numbers in the shots. Then, the following process is executed in an interval where printing of the medium (paper) is not being performed (between pages) (Y in S203).

In the driving period of the repeating cycle T of the drive signal COM, the switches 86 corresponding to all of the nozzles are turned "on," and the waveform of the drive signal COM is applied to all of the piezoelectric actuators 422. Flushing is performed thereby (S204).

In the subsequent testing period, only the switch 86 corresponding to the nozzle to be tested is turned "on," and the switches 86 other than that of the nozzle to be tested are turned "off." In so doing, application of the drive signal COM to the piezoelectric actuators 422 is interrupted for nozzles other than the nozzle to be tested. For the nozzle to be tested, the constant drive signal COM is applied to the corresponding piezoelectric actuator 422. Further, during the testing period, the controller 60 brings the gate select signal DSEL to the residual oscillation sensing circuit 55 to L level, and the transistor Q of the residual oscillation sensing circuit 55 goes "off." In so doing, electromotive force of the piezoelectric actuator 422 corresponding to the nozzle to be tested flows to the residual oscillation sensing circuit 55. The residual oscillation sensing circuit 55 then performs sensing of residual oscillation of the nozzle to be tested (S205), and from the sensed result thereof, the controller 60 decides whether the nozzle to be tested has recovered from thickening (S206).

Then, if the controller 60 decides that a nozzle has not recovered (N in S206), the "Thickening" flag for that nozzle is kept (S207), and it is decided whether ejection operations equal in number to the established shot count have been performed (S208). In a situation where ejection operations equal to the established shot count have not been performed (N in S208), the nozzle to be tested switches to the next nozzle (S209), and the process again returns to Step S204. On the other hand, in a situation where operations equal to the shot count have been performed (Y in S208), the process returns to Step S110 of FIG. 20.

If decided in Step S206 that a nozzle has recovered (Y in S206), the "Thickening" flag for that nozzle is cleared (S210), and it is decided whether all of the "Thickening" flags have been cleared (S211). If it is not true that all of the "Thickening" flags are clear (N in S211), the decision of Step S208 is performed. On the other hand, if it is true that all of the "Thickening" flags are clear (Y in S211), the process terminates.

As described above, in the printer 1 of the present embodiment, when ink is ejected from a plurality of nozzles based on print data, one nozzle is selected therefrom as a nozzle to be tested, and nozzle testing is performed on this nozzle to be tested by the residual oscillation sensing circuit 55. During this selection, the nozzles that eject the ink are identified on the basis of the print data, and a nozzle with low ejection frequency based on the print data is selected as the nozzle to be tested, from among the untested nozzles.

In so doing, precedence in testing is given to nozzles with lower ejection frequency. Therefore, nozzle testing of the nozzles can be performed more reliably.

Moreover, in situations where there are a plurality of nozzles of identical ejection frequency among the untested nozzles, precedence in testing is given to nozzles with a longer interval between ejection. Further, in situations where there are no untested nozzles, precedence in testing is given to nozzles with a longer interval since ejection testing last took place (interval between tests).

In so doing, nozzle testing can be performed in a manner that takes the effects produced by drying out of the ink into account.

Other Embodiments

Whereas a printer has been described as one preferred embodiment, the embodiment shown hereinabove is intended to aid in understanding of the present invention, and should not be construed as limiting the invention. Various modifications and improvements to the invention are possible without departing from the spirit of the invention, and these equivalents shall be considered to lie within the scope thereof. In particular, the following embodiments are considered to lie within the scope of the invention.

Liquid Ejection Device

The embodiment described above relates to an inkjet printer as an example of the liquid ejection device. However, the liquid ejection device is not limited to an inkjet printer, and embodiment in liquid ejection devices that eject fluids besides ink (such as liquids, liquiform bodies containing dispersed particles of functional materials, or fluidiform bodies such as gels) is also possible. For example, techniques analogous to the preceding embodiment may be implemented in various types of devices that use inkjet technology, such as color filter production devices, dyeing devices, microfabrication devices, semiconductor production devices, surface processing devices, 3D modeling devices, gas vaporization devices, organic EL production devices (particularly polymer EL production devices), display production devices, deposition devices, and DNA chip production devices. Methods and production methods therefore also lie within the scope of application.

While printer of the embodiment described above is one that repeats conveyance operations and dot forming operations in alternating fashion (a so-called serial printer), the printer is not limited thereto. Optionally, the printer may be, for example, one provided with a head of length equal to the paper width and adapted to eject ink from the head onto a medium being conveyed (a so-called line printer).

Ink

While the preceding embodiment is a printer embodiment that ejects ink from nozzles, the ink may water based or oil based. The liquid that is ejected from the nozzles is not limited to ink. For example, liquids containing metal materials, organic materials (particularly polymeric materials), magnetic materials, conductive materials, wiring materials, film forming materials, electronic ink, processing fluids, gene solutions, and the like (including water) may be ejected from nozzles.

Printer Driver

According to the embodiment described previously, generation of print data is carried out by the printer driver at the computer 110 end, but no limitation is imposed thereby. For example, if a program for accomplishing the functions necessary to perform generation of the print data of the present embodiment is stored in any of various types of storage, such as memory, of the printer 1, it is possible for the processes described previously to be performed by the printer 1.

Moreover, whereas in the embodiment described previously, the controller 60 performs the assignment of nozzles to be tested, optionally, the printer driver may perform the assignment of nozzles to be tested, on the basis of the print data.

Selection of Nozzle to be Tested

According to the embodiment described previously, the nozzle to be tested is selected on the basis of ejection frequency in a single pass, but optionally, the nozzle to be tested may be selected on the basis of ejection frequency in a period other than a single pass.

Also, according to the embodiment described previously, in situations where the untested nozzles have identical ejection frequency, the nozzle to be tested is selected giving precedence to nozzles that have not ejected ink for longer periods, but optionally, the nozzle to be tested may be selected on the basis of remaining ejection frequency.

For example, in the situation of row D5 of FIG. 18, the ejection frequency is six times for both nozzle #4 and nozzle #5 which eject ink, and therefore nozzle #5, which has not ejected ink for a longer period, is selected. However, in this situation, the ejection frequency in row D6 and subsequent is three times for nozzle #4 and four times for nozzle #5, and therefore the frequency of ejection of ink in the remaining period is less for nozzle #4. Specifically, there are fewer opportunities for nozzle #4 to become a candidate for nozzle testing. Therefore, in this situation, nozzle #4 may be selected. In this situation as well, nozzle testing of nozzles can be performed reliably.

Nozzle Testing

In the embodiment described above, nozzle testing is performed both during printing and during flushing, but optionally, nozzle testing may be performed during printing only.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a plurality of nozzles arranged to eject a liquid; and a common ejection testing portion provided in common to the nozzles, the common ejection testing portion being arranged to perform ejection testing of each of the nozzles during printing, at least one of the nozzles being selected to be tested using the common ejection testing portion when the liquid is ejected from the nozzles based on print data, the nozzles that eject liquid being identified based on the print data, and one of the nozzles, which have not been tested, having low ejection frequency based on the print data being selected as the at least one of the nozzles to be tested, when the nozzles, which have not been tested, have identical ejection frequency, one of the nozzles that does not eject the liquid for a prolonged period based on the print data being selected as the at least one of the nozzles to be tested.

2. The liquid ejection device according to claim 1, wherein when all of the nozzles that eject the liquid based on the print data have been tested, one of the nozzles for which a prolonged interval has passed since ejection testing last took place is selected as the at least one of the nozzles to be tested.

3. The liquid ejection device according to claim 1, further comprising a plurality of piezoelectric elements provided in respective correspondence to the nozzles, and a drive signal generating portion arranged to generate a drive signal which repeats for each of ejection cycles in which the nozzles eject the liquid onto a pixel, the drive signal having a testing period within each of the ejection cycles, at least one of the piezoelectric elements corresponding to the at least one of the nozzles to be tested being driven within a given ejection cycle of the drive signal, whereupon the at least one of the nozzles to be tested is tested using the common ejection testing portion during the testing period of the same given ejection cycle.

4. The liquid ejection device according to claim 3, further comprising a plurality of first switches provided individually to the piezoelectric elements, the first switches being arranged to switch between applying and not applying the drive signal to one terminal of each of the piezoelectric elements, and a second switch provided in common to the piezoelectric elements, the second switch being arranged to switch between applying a prescribed voltage to the other terminals of the piezoelectric elements and outputting a voltage at the other terminals of the piezoelectric elements to the common ejection testing portion, during a period prior to the testing period, the drive signal being applied at least to the one terminal of one of the piezoelectric elements corresponding to the at least one of the nozzles to be tested, and the prescribed voltage being applied to the other terminals of the piezoelectric elements, and during the testing period, the drive signal being constant, and the drive signal being applied to the one terminal of the one of the piezoelectric elements corresponding to the at least one of the nozzles to be tested while the drive signal being not applied to terminals of the piezoelectric elements corresponding to the nozzles not to be tested, and the voltage of the other terminals of the piezoelectric elements being output to the common ejection testing portion.

5. The liquid ejection device according to claim 4, wherein the second switch is a transistor, and the common ejection testing portion has an AC amplifier circuit arranged to amplify an AC component of residual oscillation after the piezoelectric elements have been driven by the drive signal, a comparator circuit arranged to compare an output of the AC amplifier circuit to a reference voltage, and a logic circuit arranged to perform a logic operation on a control signal to a control electrode of the second switch and on an output of the comparator circuit.

6. An ejection testing method for a liquid ejection device having a plurality of nozzles for ejecting a liquid, and a common ejection testing portion provided in common to the nozzles, the common ejection testing portion being adapted to perform ejection testing of each of the nozzles during printing, the ejection testing method comprising:

identifying, based on print data, the nozzles that eject the liquid;

selecting one of the nozzles having low ejection frequency, based on the print data, as at least one of the nozzles to be tested from among the nozzles that eject the liquid and that have not been tested; and testing the at least one of the nozzles to be tested with the common ejection testing portion subsequent to ejection of the liquid from the nozzles based on the print data, when the nozzles, which have not been tested, have identical ejection frequency, one of the nozzles that does not eject the liquid for a prolonged period based on the print data being selected as the at least one of the nozzles to be tested.

* * * * *